US009353495B2

(12) United States Patent
Becicka et al.

(10) Patent No.: US 9,353,495 B2
(45) Date of Patent: May 31, 2016

(54) WING PLOW WITH ROTATABLE FLOATING CONNECTION

(75) Inventors: Kenneth F. Becicka, Central City, IA (US); Mark S. Hollinrake, Solon, IA (US); Joel A. O'Brien, Elkader, IA (US)

(73) Assignee: HENDERSON PRODUCTS, INC., Manchester, IA (US)

( * ) Notice: Subject to any disclaimer, the term of this patent is extended or adjusted under 35 U.S.C. 154(b) by 366 days.

(21) Appl. No.: 13/562,053

(22) Filed: Jul. 30, 2012

(65) Prior Publication Data

US 2013/0160333 A1 Jun. 27, 2013

Related U.S. Application Data

(60) Provisional application No. 61/513,352, filed on Jul. 29, 2011.

(51) Int. Cl.
*E01H 5/06* (2006.01)

(52) U.S. Cl.
CPC ..... *E01H 5/061* (2013.01); *E01H 5/062* (2013.01); *E01H 5/067* (2013.01)

(58) Field of Classification Search
CPC ..... E01H 5/061; E01H 5/067; E01H 5/062; A01D 34/661; E02F 3/7627
USPC ..... 37/234, 218, 241, 266, 279, 281, 282, 37/283; 172/741, 742, 743
See application file for complete search history.

(56) References Cited

U.S. PATENT DOCUMENTS 1,956,007 A * 4/1934 Davin et al. ..... 37/236
2,091,343 A * 8/1937 Soule et al. ..... 37/231
3,659,363 A * 5/1972 Snyder ..... 37/231
3,720,010 A * 3/1973 Coates ..... 37/281
4,045,892 A * 9/1977 Farrell ..... 37/236
4,357,766 A * 11/1982 Croteau et al. ..... 37/281
5,031,343 A * 7/1991 Houle et al. ..... 37/231
5,177,887 A 1/1993 McGugan et al.
5,437,113 A 8/1995 Jones
5,638,618 A 6/1997 Niemela et al.
5,819,444 A 10/1998 Desmarais
5,899,007 A 5/1999 Niemela et al.
5,909,960 A 6/1999 Jager et al.

(Continued)

OTHER PUBLICATIONS

"Para-Glide Wing Post," Monroe Snow & Ice Control, 2 pages, available to the public prior to Jul. 29, 2011.

*Primary Examiner* — Robert Pezzuto
*Assistant Examiner* — Jessica H Lutz
(74) *Attorney, Agent, or Firm* — Leydig, Voit & Mayer, Ltd.

(57) ABSTRACT

A wing plow assembly includes a mast including a support frame adapted for mounting to a chassis, a moldboard having a toe end and a heel end, and a moldboard connector assembly arranged with the moldboard and the mast to provide a rotatable floating connection between the moldboard and the mast such that the moldboard is rotatably movable over a range of travel between a plowing position and a range of tripped positions. The moldboard connector assembly includes a link arm pivotably mounted with respect to the support frame and a moldboard mount pivotably mounted to the moldboard adjacent the toe end of the moldboard. The link arm and the moldboard mount are pivotably connected to each other to permit relative rotation therebetween. The moldboard can pivot from a plowing position to a tripped position when a cutting edge of the moldboard strikes an obstruction.

26 Claims, 28 Drawing Sheets

(56) References Cited

U.S. PATENT DOCUMENTS

| | | | | |
|---|---|---|---|---|
| 6,249,992 | B1 | 6/2001 | Irving et al. | |
| 6,363,631 | B1 * | 4/2002 | Cordingley | 37/280 |
| 6,408,549 | B1 | 6/2002 | Quenzi et al. | |
| 6,412,199 | B1 | 7/2002 | Quenzi et al. | |
| 6,412,200 | B1 | 7/2002 | Savard | |
| 6,442,877 | B1 | 9/2002 | Quenzi et al. | |
| 6,581,307 | B1 | 6/2003 | Jones et al. | |
| 6,895,698 | B2 | 5/2005 | Hollinrake et al. | |
| 6,941,686 | B2 | 9/2005 | Cusick | |
| 7,000,338 | B2 | 2/2006 | Savard | |
| 7,134,227 | B2 | 11/2006 | Quenzi et al. | |
| 7,263,789 | B2 | 9/2007 | Hollinrake et al. | |
| 7,523,569 | B2 | 4/2009 | Savard | |
| 7,631,442 | B2 | 12/2009 | Kost et al. | |
| 7,681,337 | B2 | 3/2010 | Watson | |
| 7,805,862 | B2 | 10/2010 | Osgood et al. | |
| 7,841,109 | B2 | 11/2010 | Stevens et al. | |
| 7,992,327 | B2 | 8/2011 | Gamble, II et al. | |
| 2007/0193074 | A1 * | 8/2007 | Savard | 37/274 |
| 2012/0017473 | A1 | 1/2012 | Paonessa | |
| 2012/0024551 | A1 | 2/2012 | Holverson et al. | |

* cited by examiner

WING PLOW WITH ROTATABLE FLOATING CONNECTION

CROSS-REFERENCE TO RELATED APPLICATIONS

This patent application claims the benefit of priority to U.S. Provisional Patent Application No. 61/513,352, filed on Jul. 29, 2011, and entitled "Plow Assembly With Link Wing Mast," which is incorporated in its entirety herein by this reference.

TECHNICAL FIELD

This patent disclosure relates generally to plows and, more particularly, to wing plows which are mounted to extend from a side of a vehicle.

BACKGROUND

Plows are commonly mounted to vehicles for use in the removal of snow or other debris from roadway surfaces. Typically a plow is mounted to the front of the vehicle such that it is generally aligned with the longitudinally-extending chassis of the vehicle. A wing plow that extends from a side of the vehicle and is offset laterally from the chassis can be used either alone or in conjunction with a standard front-mounted plow to remove snow from the sides or shoulders of roadways or to extend the plowing path width of a vehicle (e.g., such that a vehicle can plow two driving lanes of a multi-lane roadway).

The location of the wing plow to the side of the vehicle can hinder an operator's ability to see the wing plow while driving, thereby increasing the susceptibility of the wing plow to damage while in operation. To reduce damage to the wing plow and the amount of time and attention devoted by the driver to control the position of the wing plow, it is desirable to equip a wing plow with the ability to follow the ground contour, such as when the wing plow rides on and off the shoulder of the roadway, and to move over an obstruction encountered in the roadway.

A wing plow can include a trip mechanism adapted to allow a wing plow to pass over a fixed obstruction projecting from the roadway to reduce damage when the wing plow's cutting edge strikes the obstruction. A trip mechanism typically either allows the top of the moldboard to roll forward or the bottom edge of the cutting edge to independently move backward when an obstruction is contacted.

It will be appreciated that this background description has been created by the inventor to aid the reader, and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims, and not by the ability of any disclosed feature to solve any specific problem noted herein.

SUMMARY

In an embodiment, the present disclosure describes a wing plow that includes a mast including a support frame adapted for mounting to a chassis, a moldboard having a toe end and a heel end, and a moldboard connector assembly arranged with the moldboard and the mast to provide a rotatable floating connection between the moldboard and the mast such that the moldboard is rotatably movable over a range of travel between a plowing position and a range of tripped positions. The moldboard connector assembly includes a link arm pivotably mounted with respect to the support frame and a moldboard mount pivotably mounted to the moldboard adjacent the toe end of the moldboard. The link arm and the moldboard mount are pivotably connected to each other to permit relative rotation therebetween.

In another embodiment, the present disclosure describes a vehicle including a chassis and a wing plow mounted to the chassis. The wing plow includes a mast including a support frame mounted to the chassis, a moldboard having a toe end and a heel end, and a moldboard connector assembly arranged with the moldboard and the mast to provide a rotatable floating connection between the moldboard and the mast such that the moldboard is rotatably movable over a range of travel between a plowing position and a range of tripped positions. The moldboard connector assembly includes a link arm pivotably mounted with respect to the support frame and a moldboard mount pivotably mounted to the moldboard adjacent the toe end of the moldboard. The link arm and the moldboard mount are pivotably connected to each other to permit relative rotation therebetween.

In yet another embodiment, the present disclosure describes a moldboard connector assembly adapted to provide a rotatable floating connection between a moldboard and a mast with a support frame such that the moldboard is rotatably movable over a range of travel between a plowing position and a range of tripped positions. The moldboard connector assembly includes a link arm adapted to be pivotably mounted with respect to the support frame of the mast and a moldboard mount adapted to be pivotably mounted to the moldboard adjacent a toe end of the moldboard. The moldboard mount and the link arm are pivotably connected to each other to permit relative rotation therebetween. The moldboard connector assembly is adapted to provide relative movement between the moldboard and the mast with three degrees of freedom.

Further and alternative aspects and features of the disclosed principles will be appreciated from the following detailed description and the accompanying drawings. As will be appreciated, the vehicles, wing plows, and moldboard connector assemblies disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

BRIEF DESCRIPTION OF THE DRAWINGS

In the following detailed description, references are made to the accompanying drawings that form a part hereof, and in which are shown by way of illustration, specific embodiments or examples. These embodiments may be combined, other embodiments may be utilized, and various changes may be made without departing from the spirit or scope of the present disclosure.

DETAILED DESCRIPTION OF EMBODIMENTS

Embodiments of vehicles, wing plows, and moldboard connector assemblies are described herein. A wing plow constructed according to principles of the present disclosure can include a moldboard connector assembly constructed in accordance with principles of the present disclosure and be mounted to a vehicle for use to plow snow from roadways, for example, or to plow other materials, such as gravel or rock, for example, from roadways and other surfaces over which the vehicle traverses.

In some embodiments, a wing plow includes a mast having a support frame adapted for mounting to a chassis, a moldboard having a front or toe end and a rear or heel end, and a moldboard connector assembly arranged with the moldboard and the mast to provide a rotatable floating connection between the moldboard and the mast such that the moldboard is rotatably movable over a range of travel between a plowing position and a range of tripped positions. The moldboard connector assembly includes a link arm pivotably mounted with respect to the support frame and a moldboard mount pivotably mounted to the moldboard adjacent the toe end of the moldboard. The link arm and the moldboard mount are pivotably connected to each other to permit relative rotation therebetween. The moldboard connector assembly can be adapted to provide relative movement between the moldboard and the mast with three degrees of freedom. A brace assembly can be provided which positions the heel end of the moldboard away from the vehicle at a plowing angle with respect to the longitudinal axis of the vehicle chassis for plowing operations.

Embodiments of a wing plow constructed in accordance with principles of the present disclosure can help reduce damage to the wing plow when the wing plow encounters an obstruction on the surface being plowed. The wing plow can include a moldboard connector assembly constructed according to principles of the present disclosure and arranged with the moldboard and the mast to provide a rotatable floating connection between the moldboard and the mast such that the moldboard is rotatably movable between a range of plowing positions and a range of tripped positions. In use, the floating connection allows a cutting edge mounted to the moldboard to follow the contours of the surface being plowed, such as when riding on and off a shoulder of a road, rotatably trip over obstructions which resist being taken up by the cutting edge.

Figure 1:
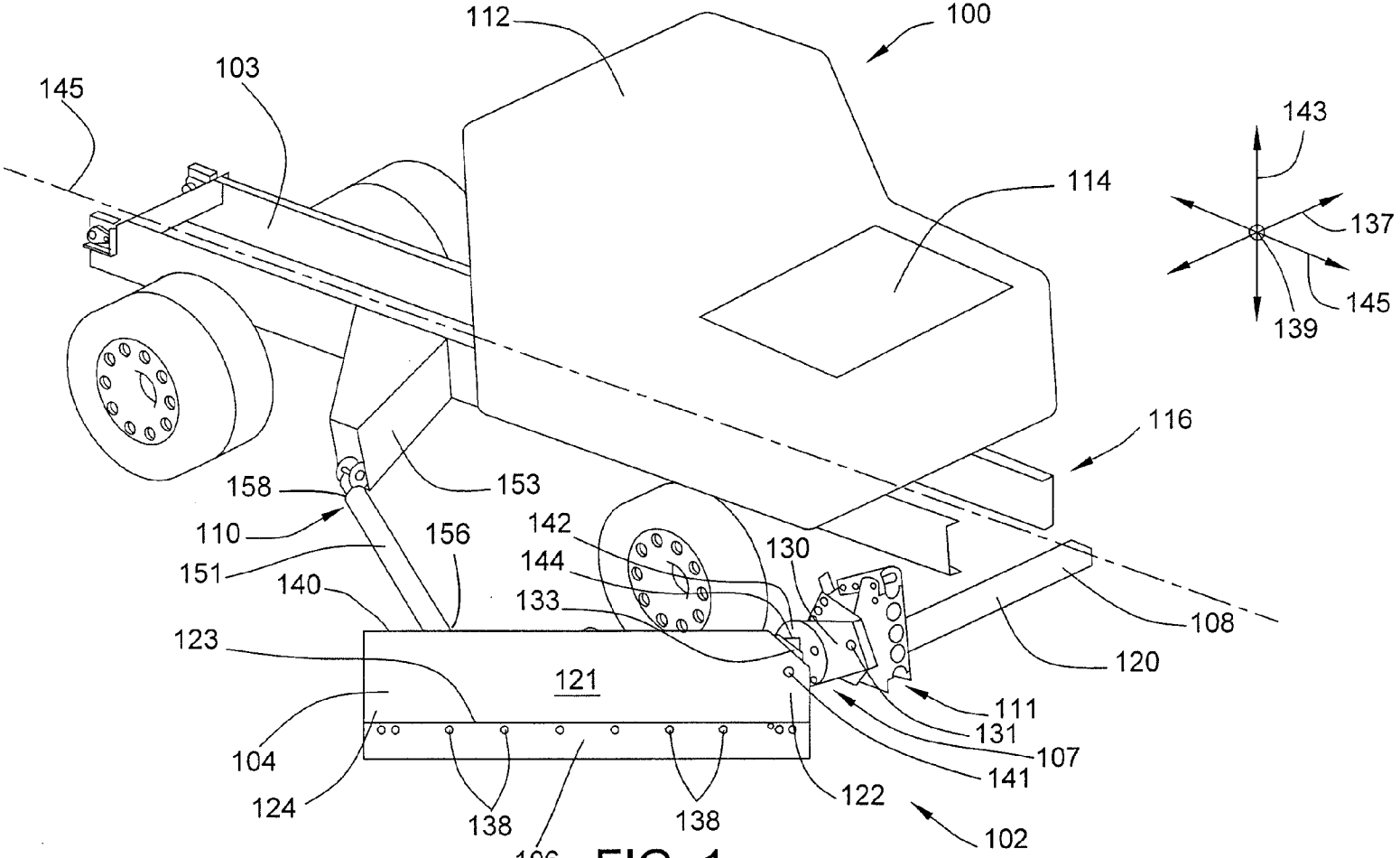
FIG. 1 is a perspective view of an embodiment of a vehicle including a wing plow constructed in accordance with principles of the present disclosure.

Turning now to the Figures, there is shown in FIG. 1 an embodiment of a vehicle 100 having a wing plow 102 constructed according to principles of the present disclosure mounted thereto. Although FIG. 1 illustrates the vehicle 100 with a single wing plow 102, it is contemplated that in other embodiments, a vehicle can be equipped with multiple wing plows constructed in accordance with principles of the present disclosure. In one arrangement, a vehicle can be equipped with a wing plow constructed in accordance with principles of the present disclosure on the right side of the vehicle and the opposing left side of the vehicle.

The wing plow 102 includes a mast 108 including a support frame 120 adapted for mounting to a chassis 103 of the vehicle 100, a moldboard 104 having a front or toe end 122 and a rear or heel end 124, a moldboard connector assembly 107 arranged with the moldboard 104 and the mast 108 to provide a rotatable floating connection between the moldboard 104 and the mast 108 such that the moldboard 104 is rotatably movable over a range of travel between a plowing position (FIG. 1) and a range of tripped positions (see, e.g., FIGS. 3, 20, and 21), a brace assembly 110, and a lift assembly 111.

The illustrated support frame 120 of the mast 108 is in the form of a tubular cross brace. The support frame 120 provides a connection for the mast 108 to the chassis 103 of the vehicle 100. In other embodiments, the support frame 120 of the mast 108 can take any suitable form sufficient for mounting the mast 108 to the chassis of a vehicle.

Figure 16:
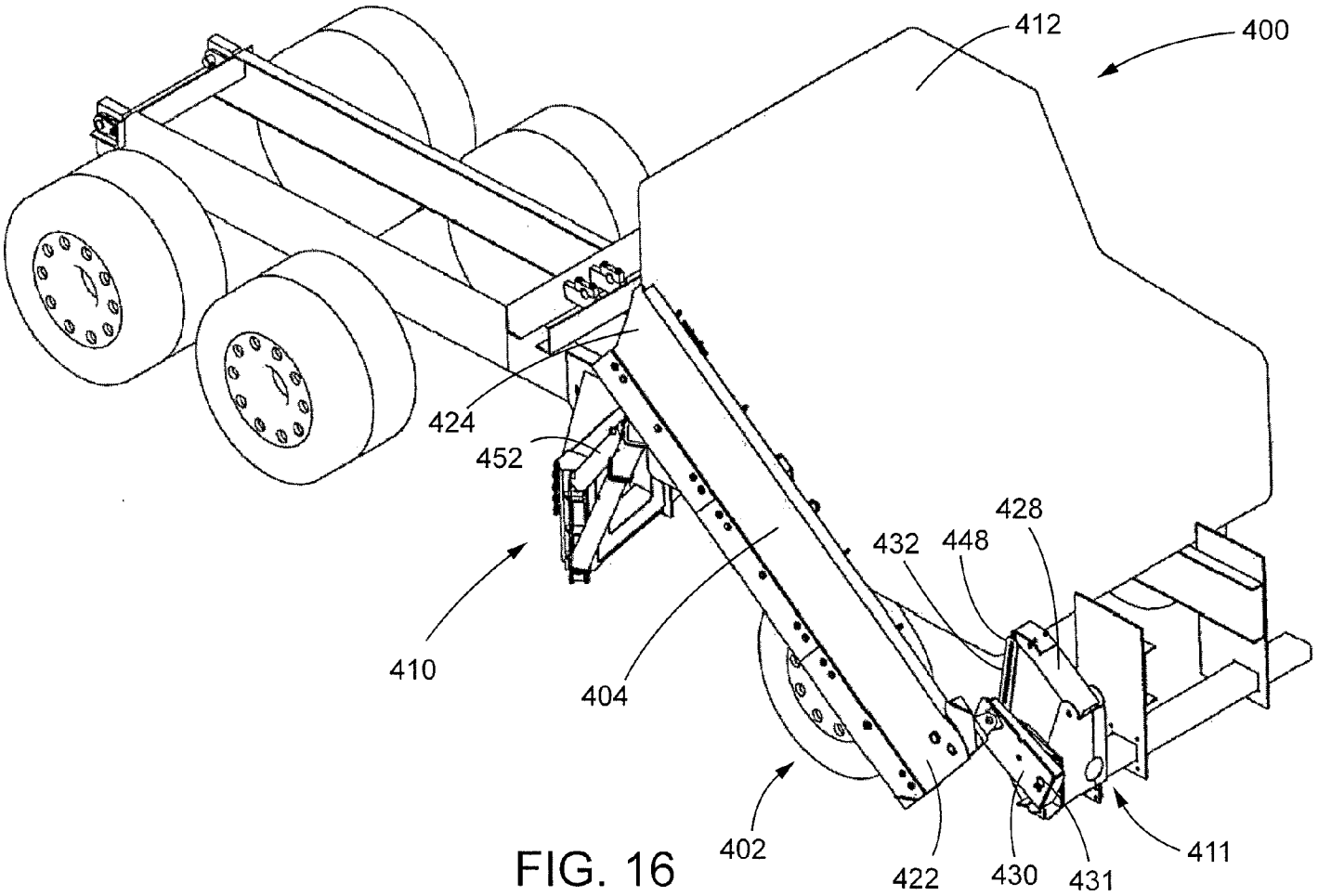
FIG. 16 is a perspective view of a vehicle with the wing plow assembly of FIG. 8 mounted thereto, illustrating the wing plow in a stowed position.

The wing plow 102 can be mounted at a front end 116 of the vehicle 100 to push snow further to a right side of the vehicle 100, as shown in FIG. 1, or the other as desired. The illustrated mast 108 has a low profile and is positionable in various locations relative to a cab 112 of the vehicle 100 without interfering with other components of the vehicle, such as an engine compartment 114 of the cab 112, a front plow (not shown), or tires of the vehicle, for example. For example, the wing plow 102 can be mounted to the vehicle 100 with the mast 108 either fore (as shown in FIGS. 1 and 16, for example) or aft relative to the cab 112. Positioning of the wing plow 102 can depend on the other equipment mounted to, and the intended use of, the vehicle 100. The low-profile of the mast 108 can help improve the driver's line of vision, easy access to the engine compartment 114, and allow for mounting the wing plow 102 behind the cab 112 underneath different conventional truck bodies.

The moldboard 104 can be made from a substantially rigid material, such as metal (e.g., steel) that defines a material moving or plowing surface 121. In some embodiments, the moldboard 104 can be constructed from sheet metal and include stiffening ribs 126 (see, e.g., FIG. 2) or members to enhance the rigidity of the moldboard. The plowing surface 121 can be concave in some embodiments. The moldboard 104 can have different configurations. For example, in embodiments, the moldboard 104 can be substantially uniform in cross section from the heel end 124 to the toe end 122 (as shown in FIG. 1, e.g.), tapered from the heel end 124 to the toe end 122, or tapered and flared from the heel end 124 to the toe end 122.

Figure 2:
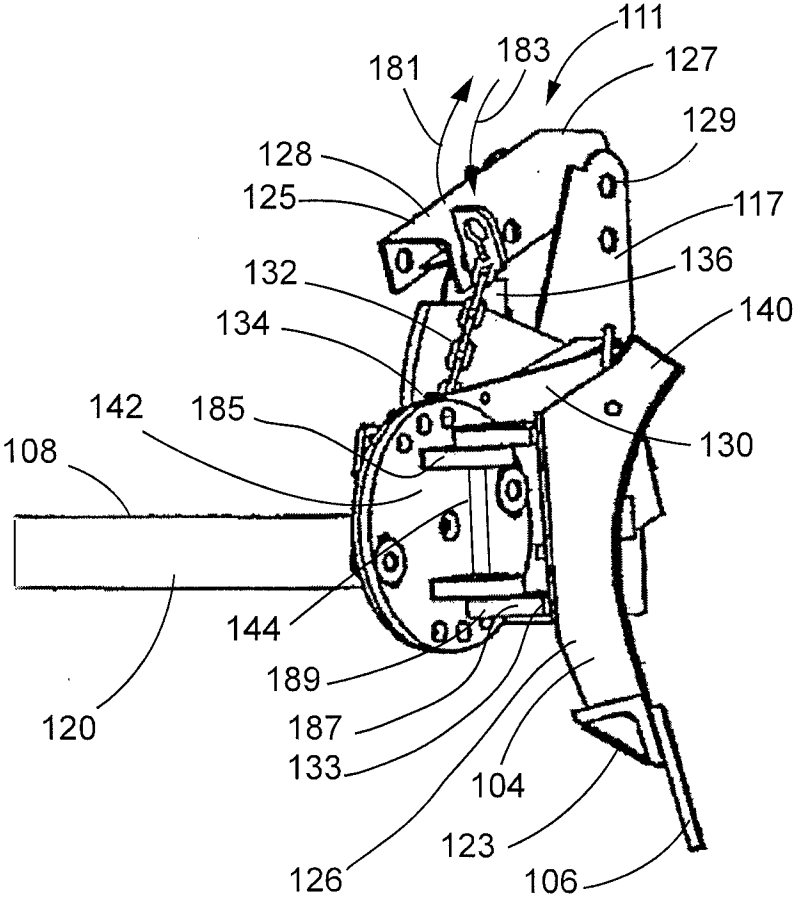
FIG. 2 is a perspective view of a portion of the wing plow of FIG. 1, illustrating the wing plow in a plowing position.

A cutting edge 106 is mounted to a bottom portion 123 of the moldboard 104. In an embodiment suitable for plowing snow, the cutting edge 106 is a relatively rigid member. The cutting edge 106 can be constructed from any suitable material, such as steel, for example. Fasteners 138 removably secure the cutting edge 106 to the moldboard 104. The cutting edge 106 can extend below the bottom portion 123 of the moldboard 104 as shown in FIG. 2. The cutting edge 106 is connected to the moldboard 104 and constitutes a ground-engaging member that contacts the ground surface during plowing operations. In some embodiments, a carbide-impregnated metal can be used for the cutting edge to improve its wear life.

Referring to FIG. 1, the moldboard connector assembly 107 is adapted to provide relative movement between the moldboard 104 and the mast 108 with three degrees of freedom. The moldboard connector assembly 107 includes a link arm 130 pivotably mounted with respect to the support frame 120 and a moldboard mount 133 pivotably mounted to the moldboard 104 adjacent the toe end 122 of the moldboard. The link arm 130 and the moldboard mount 133 are pivotably connected to each other to permit relative rotation therebetween. In some embodiments, the moldboard connector assembly 107 includes a single link arm 130.

The link arm 130 is pivotably movable with respect to the support frame 120 about a link arm pivot axis 137 defined by a link arm pivot pin 131. The moldboard 104 is pivotably movable with respect to the moldboard mount 133 at the toe end 122 about a toe end moldboard pivot axis 139 defined by a moldboard pivot pin 141. The moldboard mount 133 is pivotably movable with respect to the link arm 130 about a plowing axis 143 defined by a king pin 144. The plowing axis 143 is generally perpendicular to the link arm pivot axis 137 and to the toe end moldboard pivot axis 139. The link arm pivot axis 137 and the toe end moldboard pivot axis can be in oblique relationship with respect to each other such that they are in non-perpendicular relationship to each other.

The moldboard connector assembly 107 can include an adjustment mechanism 142 adapted to change the orientation of the plowing axis 143 with respect to a supporting ground surface. The illustrated adjustment mechanism 142 is in the form of a circular disk which is adapted to be adjustable relative to the link arm 130. The adjustment disk 142 includes an attachment point for the moldboard mount 133 such that the orientation of the plowing axis 143 can be adjusted to be substantially vertical relative to a supporting surface upon which the vehicle 100 sits (and substantially perpendicular to a longitudinal axis 145 of the chassis 103) when the wing plow 102 is in a plowing position, as shown in FIG. 1.

The moldboard connector assembly 107 provides a floating connection between the moldboard 104 and the mast 108 which allows the vertical position of the cutting edge 106 along the plowing axis 143 and a vertical axis generally perpendicular to the ground to vary to follow the contour of the surface over which the vehicle traverses. The link arm 130 can pivot about the link arm pivot axis 137 to permit the floating movement. The moldboard connector assembly 107 is also adapted to provide a tripping relief action when the wing plow 103 strikes an obstruction upon the surface being plowed which resists being lifted up by the cutting edge 106. The moldboard connector assembly 107 allows the cutting edge 106 to rotate such that when encountering an obstruction, it moves from a plowing position (see, e.g., FIG. 2) back along the longitudinal axis 145 of the chassis 103 and upward along the vertical axis 143 relative to the mast 108 to a tripped position (see, e.g., FIG. 3).

Referring to FIG. 1, the brace assembly 110 is adapted to support the moldboard 104 in a plowing position to help the moldboard 104 resist pivoting about the vertical plow axis 143 when subjected to the resistance forces of the snow (or other material) being plowed. The brace assembly 110 is also adapted to allow the wing plow 102 to move through a tripping sequence when encountering an obstruction and to return to a plowing position.

The brace assembly 110 includes a push arm 151 pivotably connected to a mounting bracket 153. The mounting bracket 153 is mounted to the chassis 103. The push arm 151 includes a distal end 156 pivotably mounted to the moldboard 104 adjacent the heel end 124 of the moldboard 104 and a proximal end 158 pivotably mounted to the mounting bracket 153.

Figure 26:
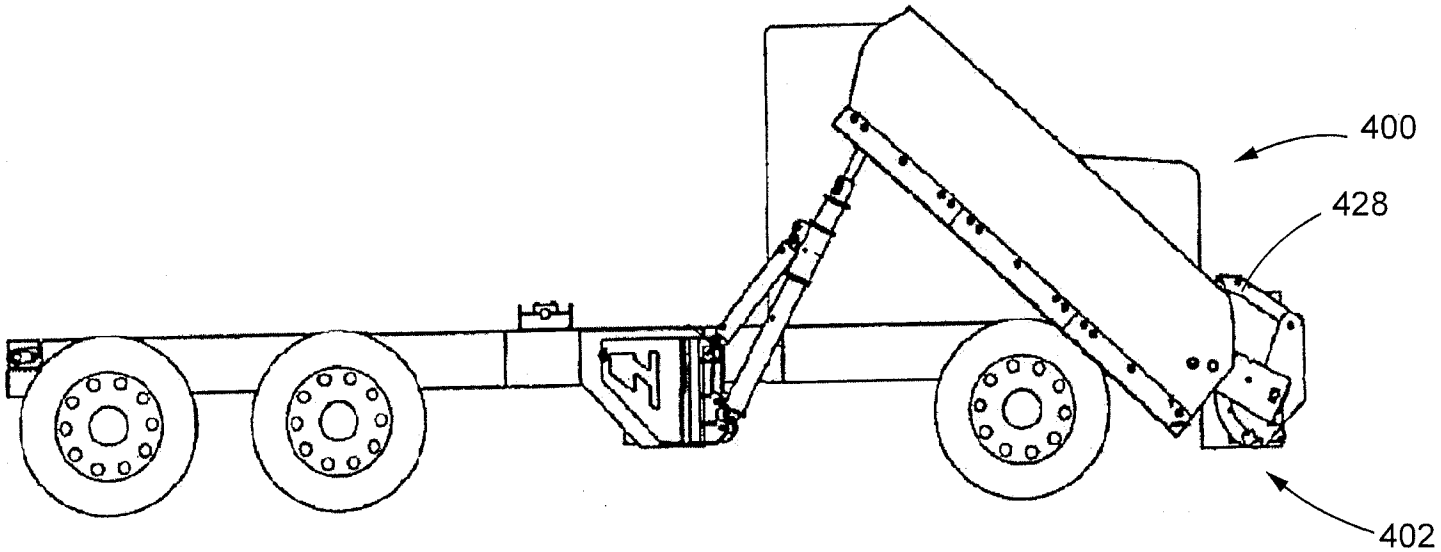
FIG. 26 is a side elevational view of the vehicle of FIG. 22, illustrating the wing plow in a stowed position.

Referring to FIG. 1, the lift assembly 111 comprises a toe end lift assembly mounted to the support frame 120 and adapted to selectively move the toe end 122 of the moldboard 104 over a range of travel along the vertical plowing axis 143 relative to the mast 108 between a plowing position (see, e.g., FIG. 1) and a stowed position (see, e.g., FIG. 26). The toe end lift assembly 111 is connected to the link arm 130 such that the link arm 130 is allowed, without operation of the toe end lift assembly 111, to float during plowing operations to allow the cutting edge 106 to follow the contour of the supporting ground surface.

Referring to FIG. 2, the toe end lift assembly 111 includes an upright 117 extending from the support frame 120, a lift arm 128 pivotably mounted to the upright 117, an actuator 136 in the form of a hydraulic cylinder pivotably mounted to the support frame 120 and to the lift arm 128, and a support linkage 132 connected to the lift arm 128 and to the link arm 130. The actuator 136 is adapted to move the lift arm 128 over a range of travel between a plowing position (see, e.g., FIG. 2) and a storage position (see, e.g., FIG. 26).

In the illustrated embodiment, the upright 117 includes a pair of walls in spaced relationship to each other to accommodate the lift arm 128 therebetween. The lift arm 128 is pivotable relative to the upright 117 about a lift arm pivot pin 129 on a proximal end 127 of the lift arm 128. A distal end 125 of the lift arm 128 can pivot upwardly in a storage direction 181 when the actuator 136 is extended and downwardly in a plowing direction 183 when the actuator 136 is retracted.

The lift arm 128 is connected to the link arm 130 by the support linkage 132. The illustrated support linkage 132 comprises a flexible tension device extending between the distal end 125 of the lift arm 128 and a distal end 134 of the link arm 130. The support linkage 132 can be adapted to constrain the link arm 130 from pivoting in a lowering direction beyond a lowered position (such as, when the link arm 130 is pivoted downwardly so that the illustrated support linkage 132 is taut) but to allow the link arm 130 to pivot in a lifting direction away from the lowered position without the need to operate the lift assembly 111. Although the illustrated embodiment shows the support linkage 132 as a chain, it is contemplated that in other embodiments other suitable devices, such as a cable, cord, or rope, may be used. Furthermore, in other embodiments, the support linkage 132 can be a device other than a flexible tension device (e.g., a slide linkage) which still permits the link arm 130 to float when the wing plow is in a plowing position.

In use, the hydraulic cylinder 136 can be used to operate the lift assembly 111 such that the position of the wing plow 102 can move from a plowing position to a stowed position. As the cylinder 136 raises the lift arm 128, the lift arm 128 pivots about the lift arm pivot pin 129 on the mast end 127 of the lift arm 128. The cylinder 136 raises the link end 125 of the lift arm 128, thereby taking up any slack in the support linkage 132. When the support linkage 132 is taut, continued upward movement of the lift arm 128 raises the distal end 134 of the link arm 130 (which pivots about the link arm pivot axis 137) and the toe end 122 of moldboard 104. To lower the wing plow 102 from a stowed position to a plowing position, the cylinder 136 lowers the lift arm 128, thereby allowing the support linkage 132 to move downwardly, which in turn lowers the link arm 130 until the cutting edge 106 comes into contact with the supporting ground surface. The cylinder 136 can continue to be retracted to provide slack in the support linkage 132, which in turn can allow the cutting edge 106 to float both upwardly and downwardly relative to a vertical position of a reference supporting ground surface such that the cutting edge 106 can move downwardly into a dip in the supporting surface and upwardly over a bump. In some embodiments, the length of the support linkage 132 can be adjusted to set the vertical height of the moldboard 104 relative to the mast 108.

Referring to FIG. 2, the adjustment disk 142 includes a clevis bracket 185 having a pair of mounting lugs in spaced relationship to each other. The moldboard mount 133 includes a dee or connector plate 187 having a clevis bracket 189 which is adapted to be aligned with and inter-engage the clevis bracket 185 of the adjustment disk 142. The link arm 130 and the connector plate 187 are pivotably connected together by a king pin 144 extending through the clevis brackets 185, 189.

Figure 3:
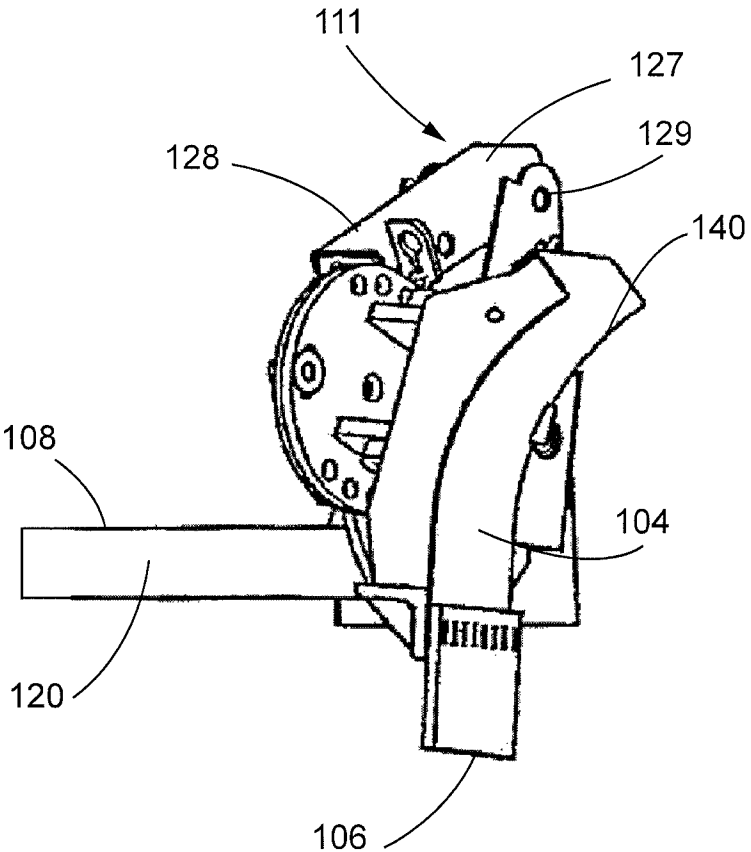
FIG. 3 is a perspective view of the wing plow of FIG. 1 as in FIG. 2, but illustrating the wing plow in a tripped position.

FIGS. 2 and 3 illustrate the movement of the moldboard 104 through a tripping sequence between a plowing position shown in FIG. 2 and a tripped position shown in FIG. 3. As the wing plow 102 strikes an obstruction, the link arm 130 pivots upwardly about the link arm pivot axis 137. As the link arm 130 pivots upward, it also changes the orientation of the moldboard 104 so that the cutting edge 106 moves backward along the longitudinal axis 145 relative to the mast 108 so that a cutting angle formed between the cutting edge 106 and the supporting ground surface is reduced, as shown in FIG. 3, and so that the cutting edge 106 moves vertically upward relative to the supporting surface to clear the obstruction. A top portion 140 of the moldboard 104 rolls forward to allow the cutting edge 106 to pass over the obstruction. The lift arm 128 remains in the same position in the plowing position and in the tripped position. When the obstruction is cleared, the moldboard 104 moves from the tripped position in FIG. 3 back to the plowing position in FIG. 2. During operation, the cutting edge 106 can float over the ground contour and over obstructions to reduce damage to the wing plow 102 and to reduce the need for operator intervention while still applying sufficient downward force to remove ice, snow, or other debris from the plowed area.

Figure 4:
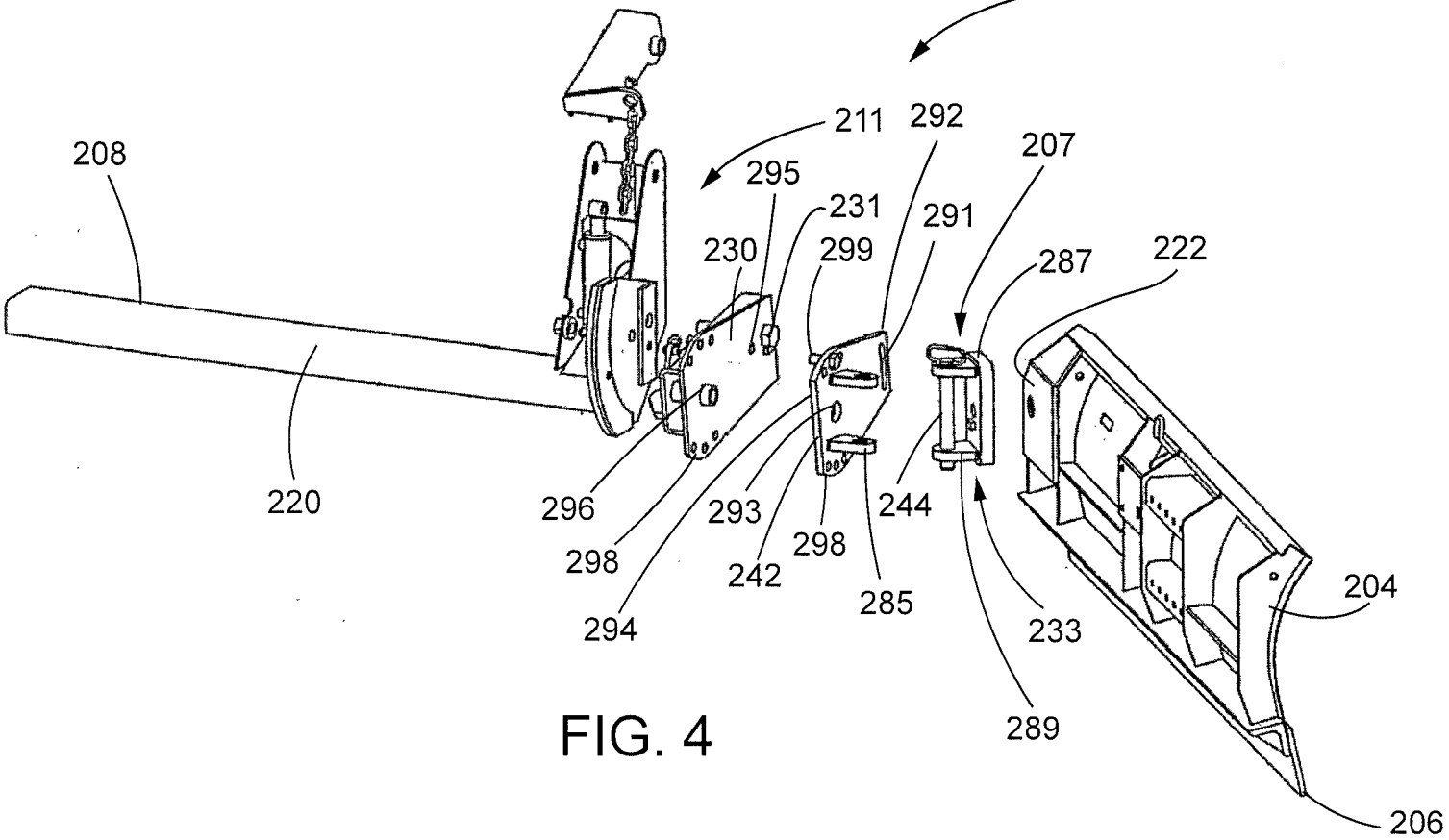
FIG. 4 is an exploded view of another embodiment of a front portion of a wing plow constructed in accordance with principles of the present disclosure, the front portion including a mast, a moldboard connector assembly, and a moldboard with a cutting edge mounted thereto.

Referring to FIG. 4, another embodiment of a front portion 201 of a wing plow constructed in accordance with principles of the present disclosure is shown. The front portion 201 includes a mast 208 having a support frame 220 adapted for mounting to a chassis of a vehicle, a moldboard 204 having a cutting edge 206 connected thereto, a moldboard connector assembly 207 arranged with the moldboard 204 and the mast 208 to provide a rotatable floating connection between the moldboard 204 and the mast 208 such that the moldboard 204 is rotatably movable over a range of travel between a plowing position and a range of tripped positions, and a lift assembly 211.

The moldboard connector assembly 207 is adapted to provide relative movement between the moldboard 204 and the mast 208 with three degrees of freedom. The moldboard connector assembly 207 includes a link 230 pivotably mounted with respect to the support frame 220, a moldboard mount 233 pivotably mounted to the moldboard 204 adjacent a toe end 222 of the moldboard 204, and an adjustment mechanism 242 adjustably mounted to the link arm 230. The link arm 230 and the moldboard mount 233 are pivotably connected to each other via the adjustment mechanism 242 to permit relative rotation therebetween about a plowing axis.

The adjustment mechanism 242 is in the form of a plate and includes a clevis bracket 285. The moldboard mount 233 includes a dee or connector plate 287 having a clevis bracket 289 which is adapted to be aligned with and inter-engage the clevis bracket 285 of the adjustment plate 242. The link arm 242 and the connector plate 287 are pivotably connected together by a king pin 244 extending through the clevis brackets 285, 289.

The adjustment mechanism 242 is adapted to change the orientation of the plowing axis (extending axially along the kingpin 244) with respect to a supporting ground surface. In use, the orientation of the adjustment plate 242 relative to the link arm 230 can be varied to change the orientation of the clevis bracket 289 of the adjustment plate 242, thereby also varying the plowing axis defined by the king pin 244 inserted through the clevis bracket 289 to pivotably mount the moldboard 204. The orientation of the adjustment plate 242 can be adjusted relative to the link arm 230 to substantially align the plowing axis with a vertical axis that is substantially perpendicular to a longitudinal axis of the chassis and a supporting ground surface.

The adjustment plate 242 includes an adjustment slot 291 at a proximal end 292 of the adjustment plate. The adjustment plate can be mounted in a desired orientation relative to the link arm 230 by securing a fastener through the adjustment slot 291 and an aligned mounting hole 295 in the link arm 230. The adjustment plate 242 includes an opening 293 therethrough at a distal end 294 that can accept a pivot boss 296 projecting from the link arm 230. The orientation of the adjustment plate 242 relative to the link arm 230 can be varied by pivoting the adjustment plate 242 about the link arm pivot boss 296. The adjustment slot 291 can be configured to accommodate the movement of the adjustment plate 242 relative to the link arm 230. Additional mounting holes 298 can be provided in the adjustment plate 242 and the link arm 230 which can be aligned and accommodate fasteners 299 therethrough to further secure the adjustment plate to the link arm 230.

The components of the front portion 201 of FIG. 4 can be similar in other respects to the corresponding components of the wing plow 102 of FIG. 1. The front portion 201 can be used in a wing plow according to principles of the present disclosure as discussed in connection with the wing plow 102 of FIG. 1, for example.

Figure 5:
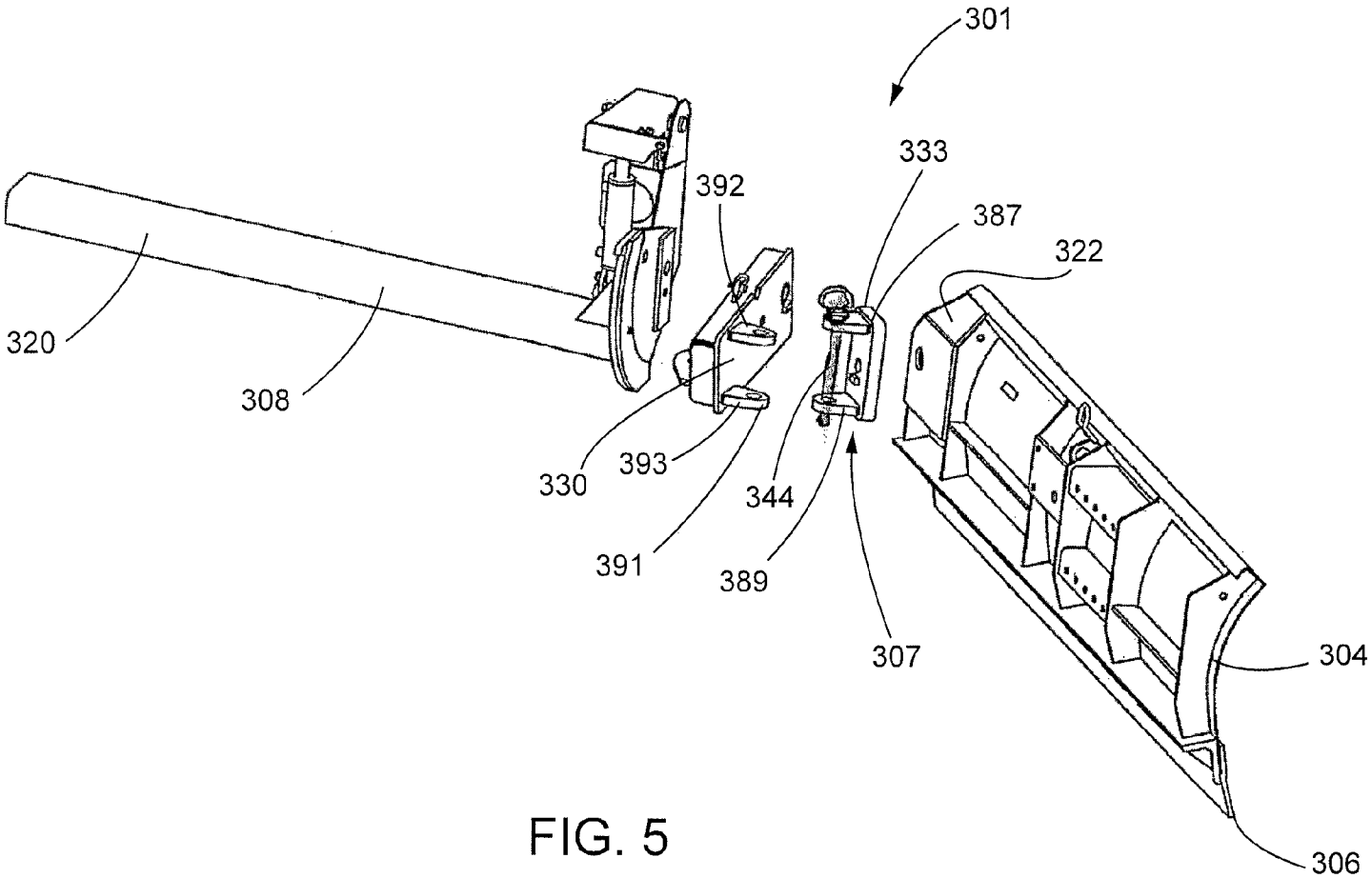
FIG. 5 is an exploded view of yet another embodiment of a front portion of a wing plow constructed in accordance with principles of the present disclosure, the front portion including a mast, a moldboard connector assembly, and a moldboard with a cutting edge mounted thereto.
Figure 6:
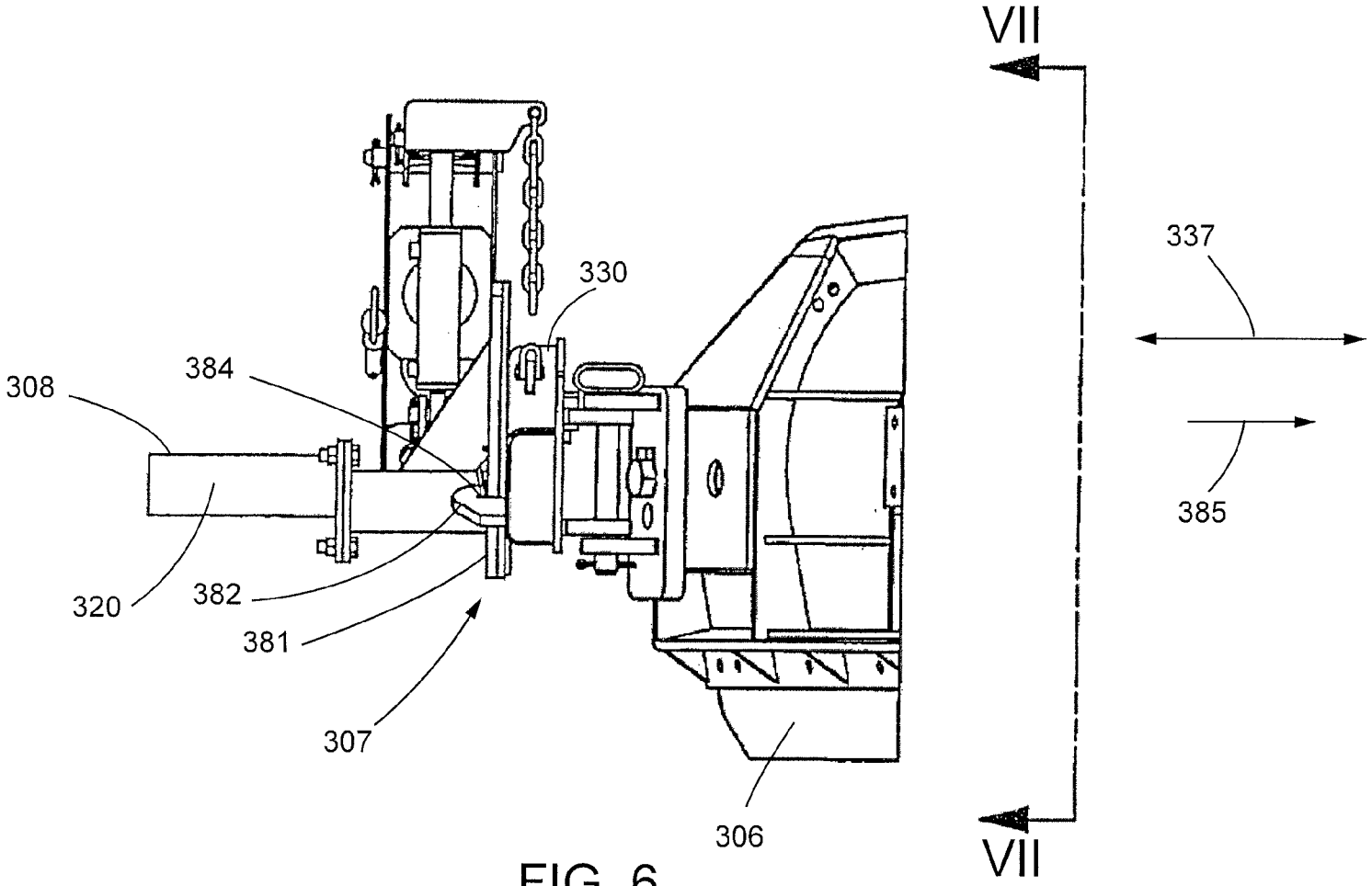
FIG. 6 is a fragmentary, rear elevational view of the front portion of the wing plow of FIG. 5.
Figure 7:
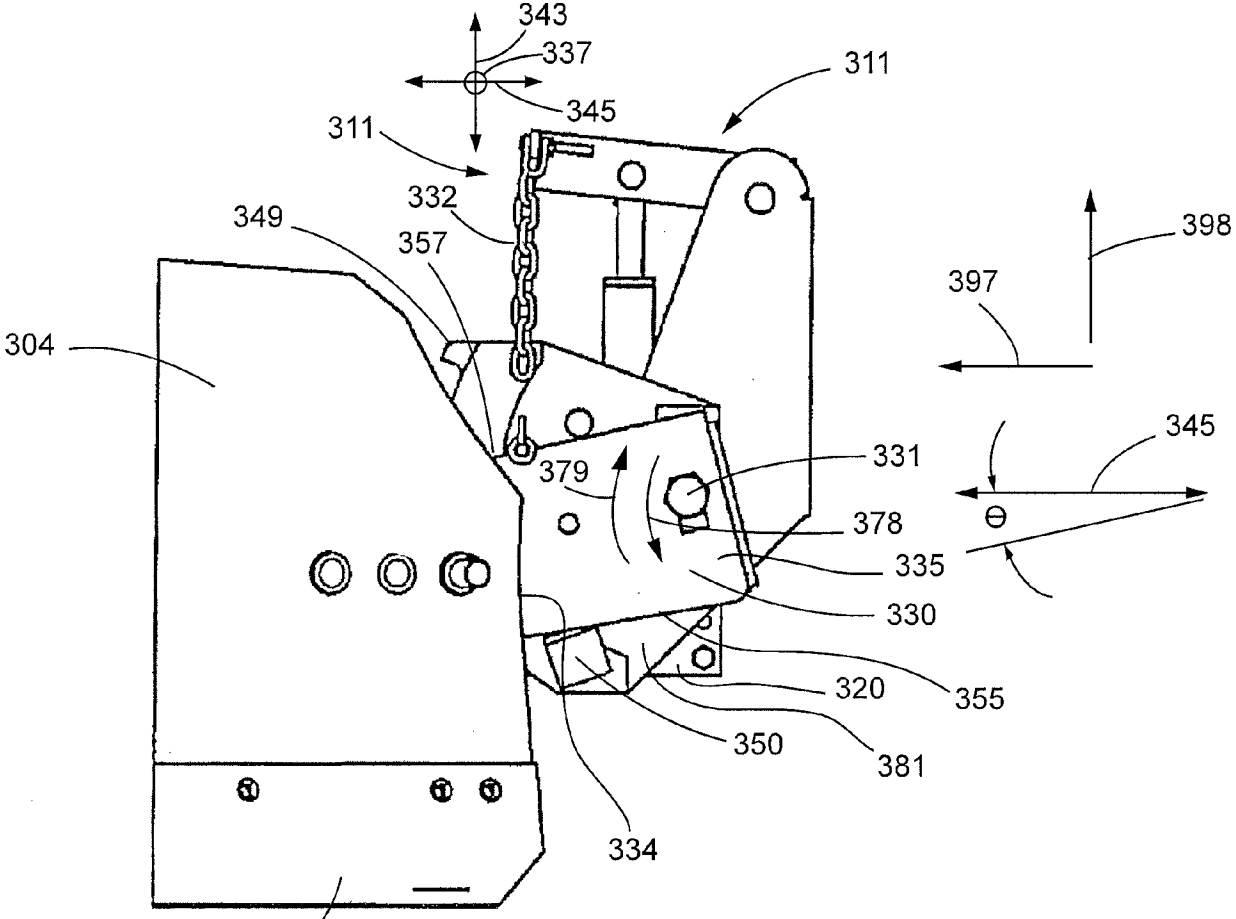
FIG. 7 is a fragmentary, side elevational view, from the vantage point of line VII-VII in FIG. 6, of the front portion of the wing plow of FIG. 5.

Referring to FIGS. 5-7, another embodiment of a front portion 301 of a wing plow constructed in accordance with principles of the present disclosure is shown. Referring to FIG. 5, the front portion 301 includes a moldboard connector assembly 307 arranged with a moldboard 304 and a mast 308 to provide a rotatable floating connection between the moldboard 304 and the mast 308 such that the moldboard 304 is rotatably movable over a range of travel between a plowing position and a range of tripped positions.

The moldboard connector assembly 307 is adapted to provide relative movement between the moldboard 304 and the mast 308 with three degrees of freedom. The moldboard connector assembly 307 includes a link arm 330 pivotably mounted with respect to the support frame 320 and a moldboard mount 333 pivotably mounted to the moldboard 304 adjacent a toe end 322 of the moldboard 304.

The link arm 330 includes a pair of fixed lugs 391, 392 extending therefrom to form a clevis bracket 393. The clevis lugs 391, 392 are adapted to receive a king pin 344 therethrough. The moldboard mount 333 includes a dee or connector plate 387 also having a clevis bracket 389 adapted to receive the king pin 344 therethrough. The connector plate 387 is pivotably mounted to the toe end 322 of the moldboard 304. The link arm 330 and the connector plate 387 are pivotably connected together by the king pin 344 extending through the clevis brackets 389, 393. This embodiment omits an adjustable mechanism.

The components of the front portion 301 of FIG. 5 can be similar in other respects to the corresponding components of the front portion 201 of FIG. 4. The front portion 301 of FIG. 5 can be used in a wing plow according to principles of the present disclosure as discussed in connection with the wing plow 102 of FIG. 1, for example.

Referring to FIG. 6, the moldboard connector assembly 307 includes a retaining plate 381 mounted to the support frame 320. The link arm 330 is pivotably mounted to the retaining plate 381 such that the link arm 330 is pivotable about a link arm pivot axis 337. The link arm 330 includes a retaining member or jaw 382 defining a groove 384. The retaining plate 381 and the link arm 330 are positioned with respect to each other such that a portion of the retaining plate 381 is disposed within the groove 384 such that the retaining member 382 is engageable with the retaining plate 381 to restrain relative movement of the link arm 330 away from the retaining plate 381 along the link arm pivot axis 337 in a lateral outward direction 385.

The retaining function provided by the inter-engagement of the jaw 382 of the link arm 330 and the retaining plate 381 mounted to the support frame 320 can be particularly useful in situations where a vehicle having a wing plow, which is constructed in accordance with principles of the present disclosure and in the plowing position, moves in reverse. Should the cutting edge 306 catch upon the supporting surface, the link arm 330 may have a tendency to move in the lateral outward direction 385 relative to the mast 308. The retaining jaw 382 can engage the retaining plate 381 to help maintain the link arm 330 in its relative lateral position.

Referring to FIG. 7, a link arm pivot pin 331 pivotably connects a proximal mast end 335 of the link arm 330 to the frame structure 320 and allows the link arm 330 to pivot about the link arm pivot axis 337 defined by the link arm pivot pin 331.

The link 330 extends longitudinally from the proximal mast end 335 to a distal end 334 (where the link arm is pivotably associated with the moldboard 304) to define a link arm angle θ with respect to the longitudinal axis of the chassis of the vehicle and the supporting ground surface (i.e., a horizontal axis) when the wing plow is in a normal plowing position with the cutting edge 306 resting upon the ground and/or the plowing axis 343 substantially vertical. The link arm angle θ determines the trip path over which the moldboard 304 moves when the wing plow strikes an obstruction. The illustrated link angle θ is about 10° below the horizontal axis 345. In embodiments, the link arm angle θ of the link arm 330 when the moldboard 304 is in a normal plowing position (with the cutting edge 306 resting upon the ground) is in a range from about 5° above the horizontal axis 345 downward to about 90° below the horizontal axis 345, in a range from about parallel with the ground downward to about perpendicular to the ground in other embodiments, in a range from about parallel to the horizontal axis 345 downward to about 60° below the horizontal axis 345 in other embodiments, in a range from about 10° below the horizontal axis 345 downward to about 45° below the horizontal axis 345 in still other embodiments, and in a range from about 10° below the horizontal axis 345 downward to about 25° below the horizontal axis 345 in yet other embodiments.

In embodiments, the link arm 330 can be oriented at a link arm angle θ that is in a range between parallel with the ground and perpendicular to the ground in order for the moldboard 304 to move both rearward horizontally 397 and upward vertically 398 relative to the support frame 320 when the cutting edge 306 strikes an obstruction. If the link arm 330 is oriented substantially at a link arm angle θ that is parallel to the ground (where the link arm angle θ is equal to about zero) and the cutting edge 306 strikes an obstruction, the link arm 330 is restrained from moving longitudinally backward along the longitudinal axis of the chassis relative to the mast 308 and can only pivot vertically upward 398 from the ground. In such a configuration, the moldboard 304 has limited rearward movement to absorb the force from the obstruction, and damage to the cutting edge 306 or the wing plow assembly could occur.

On the other hand, orienting the link arm 330 at a link arm angle θ that is perpendicular to the ground (where the link arm angle θ is equal to about 90° below) results in the link arm 330 pivoting horizontally to the ground and rearward 397 when the cutting edge 306 strikes an obstruction. In such a configuration, the moldboard 304 moves straight rearward 397 as well with limited vertical upward 398 movement. While movement straight rearward 397 may absorb some of the impact resulting from the cutting edge 306 striking an obstruction, the moldboard 304 may not have enough vertical upward 398 movement in such a configuration to raise up over the obstruction and avoid further damage.

When the link arm 330 is oriented at a link angle θ in a range between about 15° and about 30° below the horizontal axis 345 (and even more preferably at about 20° below the horizontal axis 345), the cutting edge 306 of moldboard 304 has the ability to move rearward 397 relative to the support frame 320 and absorb force from the cutting edge 306 striking an obstruction, but also to move vertically upward 398 relative to the support frame 320 and clear the obstruction to help reduce damage to the wing plow. It is contemplated, however, that other values for the link arm angle θ can be effective at reducing damage to the moldboard 304 and the wing plow upon striking an obstruction. Additionally, the optimum orientation of the link arm 330 can depend upon the specific plowing conditions and the material being cleared. As such, the link arm angle θ can be adjusted to suit the specific conditions in different embodiments.

A toe end lift assembly 311 is connected to the link arm 330 such that the link arm 330 is allowed, without operation of the toe end lift assembly 311, to float by pivoting about the link arm pivot pin 331 in a lowering direction 378 to a ground-engaging position wherein the cutting edge 306 contacts the ground when the moldboard 304 is under the influence of gravity, and in a lifting direction 379 to a tripped position when the moldboard 304 encounters an obstruction. The lifting direction 379 is in opposing relationship to the lowering direction 378.

The toe end lift assembly 311 is arranged with the link arm 330 such that the link arm 330 is constrained from pivoting in the lowering direction 378 beyond a lowered position but allowed to move in the lifting direction 379 away from the lowered position. In the illustrated embodiment, a link arm lower stop 350 is provided to define the lowered position. The link lower stop 350 is engageable with a bottom edge 355 of the link 330 to prevent the link an 330 from moving further in the lowering direction 378. The link arm lower stop 350 can be affixed to the retaining plate 381.

A link arm upper stop 349 can also be provided to limit the movement of the link arm 330 in the lifting direction 379 to a raised position. In embodiments, the link arm upper stop 349 is engageable with an upper edge 357 of the link arm 330, a retaining member, or other suitable structure to prevent the link arm 330 from moving further in the lifting direction 379, thereby defining the raised position. The link arm upper stop 349 can also be affixed to the retaining plate 381. In use, it is preferred that the link arm 330 is disposed between the lowered position and the raised position when the cutting edge 306 is resting on a reference supporting ground surface, thereby allowing the cutting edge 306 to float both upwardly and downwardly to follow the contour of the ground.

Figure 8:
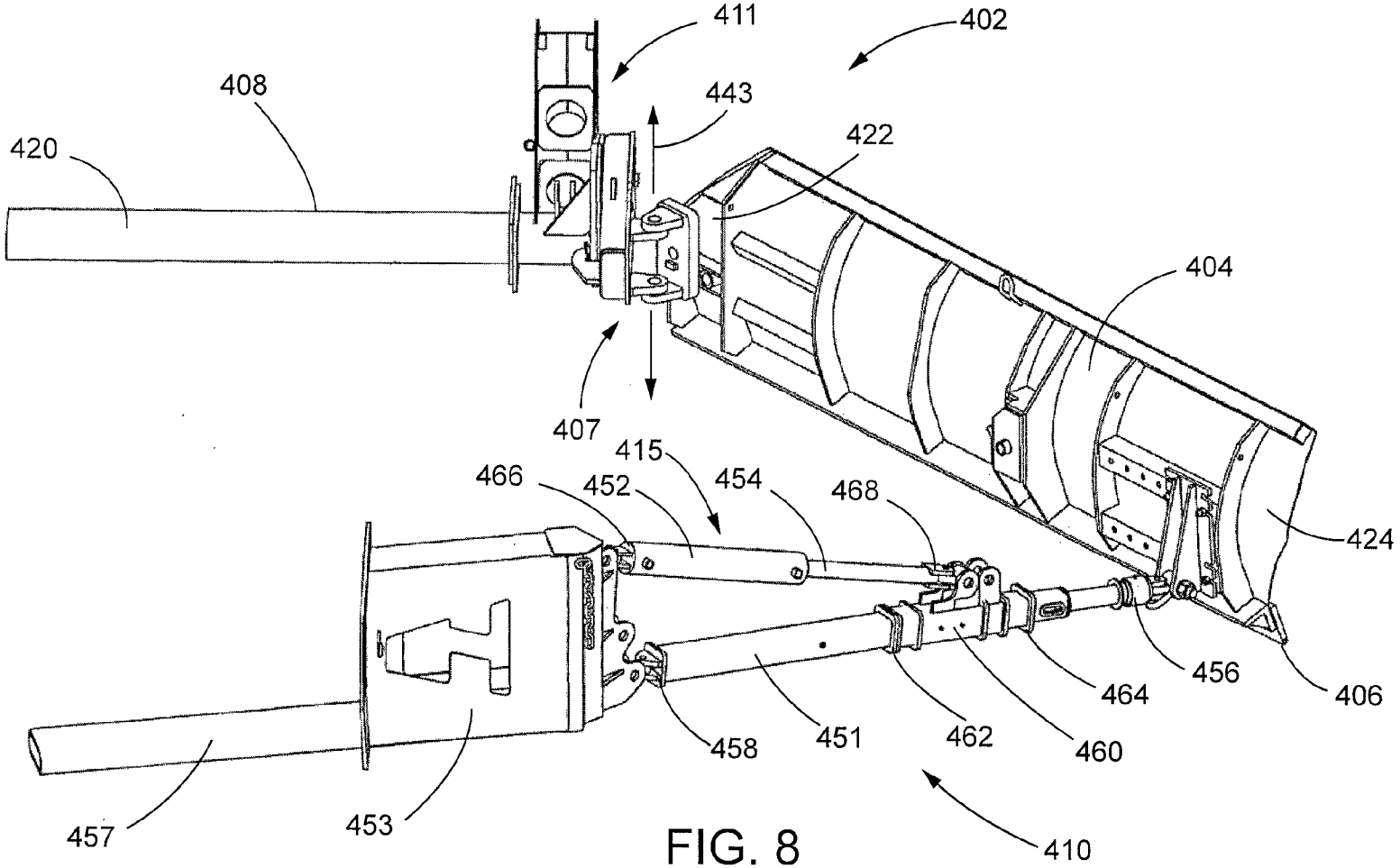
FIG. 8 is a perspective view of another embodiment of a wing plow constructed in accordance with principles of the present disclosure.

Referring to FIG. 8, another embodiment of a wing plow assembly 402 constructed according to principles of the present disclosure is shown. The wing plow 402 includes a mast 408 including a support frame 420 adapted for mounting to a chassis of a vehicle, a moldboard 404 having a front or toe end 422 and a rear or heel end 424, a moldboard connector assembly 407 arranged with the moldboard 404 and the mast 408 to provide a rotatable floating connection between the moldboard 404 and the mast 408 such that the moldboard 404 is rotatably movable over a range of travel between a plowing position (see, e.g., FIG. 19) and a range of tripped positions (see, e.g., FIGS. 20 and 21), a brace assembly 410, and a lift assembly 411.

The brace assembly 410 is adapted to support the moldboard 404 in a plowing position (e.g., as shown in FIG. 8) to help the moldboard 404 resist pivoting about the vertical plow axis 443 when subjected to the resistance forces of the snow (or other material) being plowed. The brace assembly 410 is also adapted to allow the wing plow 402 to move through a tripping sequence when encountering an obstruction to move to one of a range of tripping positions (see, e.g., FIGS. 20 and 21) and to return to a plowing position (see, e.g., FIG. 19).

The brace assembly 410 includes a push arm 451 pivotably connected to a mounting bracket 453, which in turn is mounted to a rear mast 457 adapted to be mounted to a chassis of a vehicle. The push arm 451 includes a distal end 456 pivotably mounted to the moldboard 404 adjacent the heel end 424 of the moldboard 404 and a proximal end 458 pivotably mounted to the mounting bracket 453. The pivotable connections between the push arm 451, the mounting bracket 453, and the moldboard 404 can be made using any suitable device, such as universal joints, ball joints, or any other suitable joints that allow the push arm 451 to pivot with respect to the mounting bracket 453 and the moldboard 404 with multiple degrees of freedom.

A heel end lift assembly 415 is operable to selectively move the heel end 424 of the moldboard 404 over a range of travel along the plowing axis 443 between a plowing position (see, e.g., FIG. 8) and a stowed position (see, e.g., FIG. 16). The heel lift assembly 415 includes an actuator 452 having a proximal end 466 pivotably mounted to the mounting bracket 453 and a distal end 468 pivotably mounted to the push arm 451 via a slide collar 460. The actuator 452 is movable over a range of travel between an extended position (see, e.g., FIG. 8) and a retracted position (see, e.g., FIG. 17) to place the push arm 451 in a plowing position and a stowed position, respectively.

The illustrated actuator 452 is in the form of a hydraulic cylinder having a reciprocally moving piston 454. The piston 454 is movably and sealingly mounted within the cylinder such that the piston 454 can reciprocally move in and out of the cylinder under the influence of hydraulic fluid. The connection between the actuator 452 and the mounting bracket 453 and between the actuator 452 and the slide collar 460 can be made with any suitable joint, such as universal joints, ball joints, or any other suitable joints allowing the actuator 452 to pivot with respect to the mounting bracket 453 and the slide collar 460 with multiple degrees of freedom.

The slide collar 460 is movably mounted to the push arm 451 such that the push arm 451 extends through the slide collar 460. The slide collar 460 is disposed between a proximal arm stop 462 and a distal arm stop 464 which act to define a range of travel over which the slide collar 460 is movable with respect to the push arm 451. The slide collar 460 can move along the push arm 451 between the proximal arm stop 462 and the distal arm stop 464 in response to pivotal movement of the push arm 451 when the moldboard 404 is moving through a tripping sequence, for example. The length of travel defined by the stops 462, 464 can be configured such that the moldboard 404 can move from a plowing position to a range of trip positions without interference from the heel lift assembly 415 or without requiring the heel lift assembly 415 to be operated.

The brace assembly 410 positions the heel end 424 of the moldboard 404 away from the vehicle at a plow angle for plowing snow or other materials. When the wing plow 402 is in the plowing position, the brace assembly 410 stabilizes the heel end 424 of the moldboard 404 to resist the forces encountered when plowing snow or other materials to help maintain the moldboard 404 in a plowing position.

When the cutting edge 406 strikes an obstruction which resists being lifted up by the cutting edge 406, the moldboard 404 moves rearwardly relative to the longitudinal axis of the chassis and up vertically relative to the ground into a tripped position, as discussed above. The brace assembly 410 is adapted to permit the movement of the moldboard 404 through a tripping sequence. As the moldboard 404 moves to a tripped position, the push arm 451 pivots about its proximal end 458. As the push arm 451 pivots about its proximal end 458, the slide collar 460 moves toward the distal arm stop 464 to accommodate the movement. As the moldboard 404 moves back to a plowing position, the slide collar 460 can move toward the proximal arm stop 462.

Figure 9:
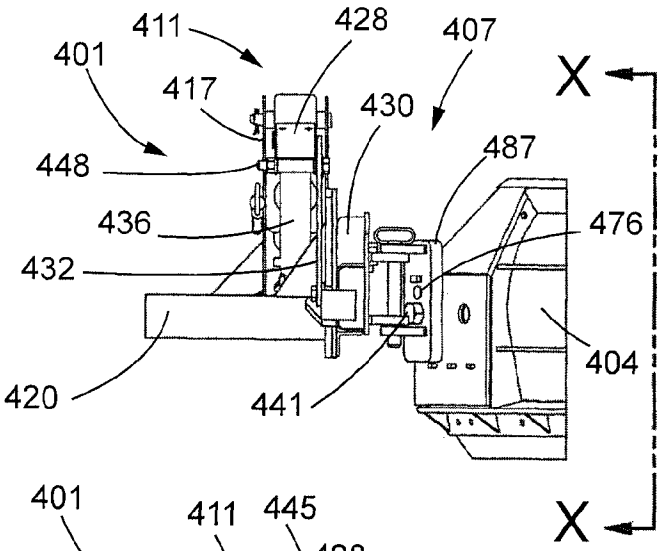
FIG. 9 is a fragmentary, rear elevational view of a front portion of the wing plow of FIG. 8.
Figure 10:
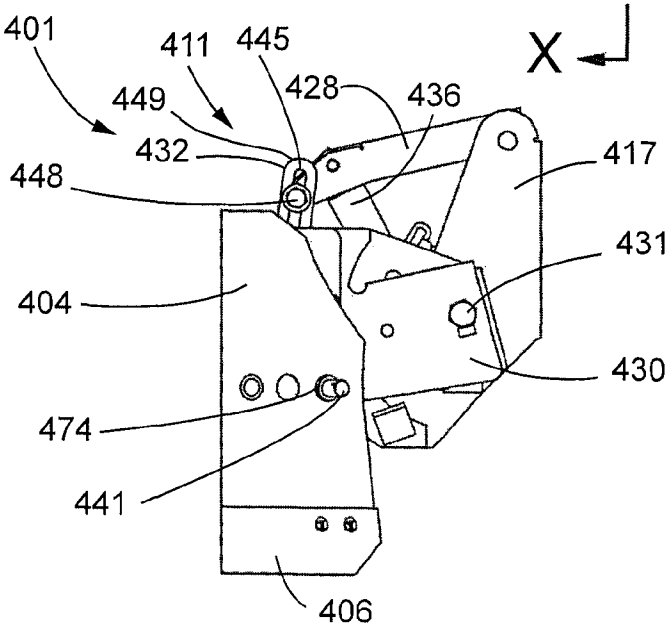
FIG. 10 is a fragmentary, side elevational view, from the vantage point of line X-X in FIG. 9, of the front portion of the wing plow of FIG. 8.
Figure 11:
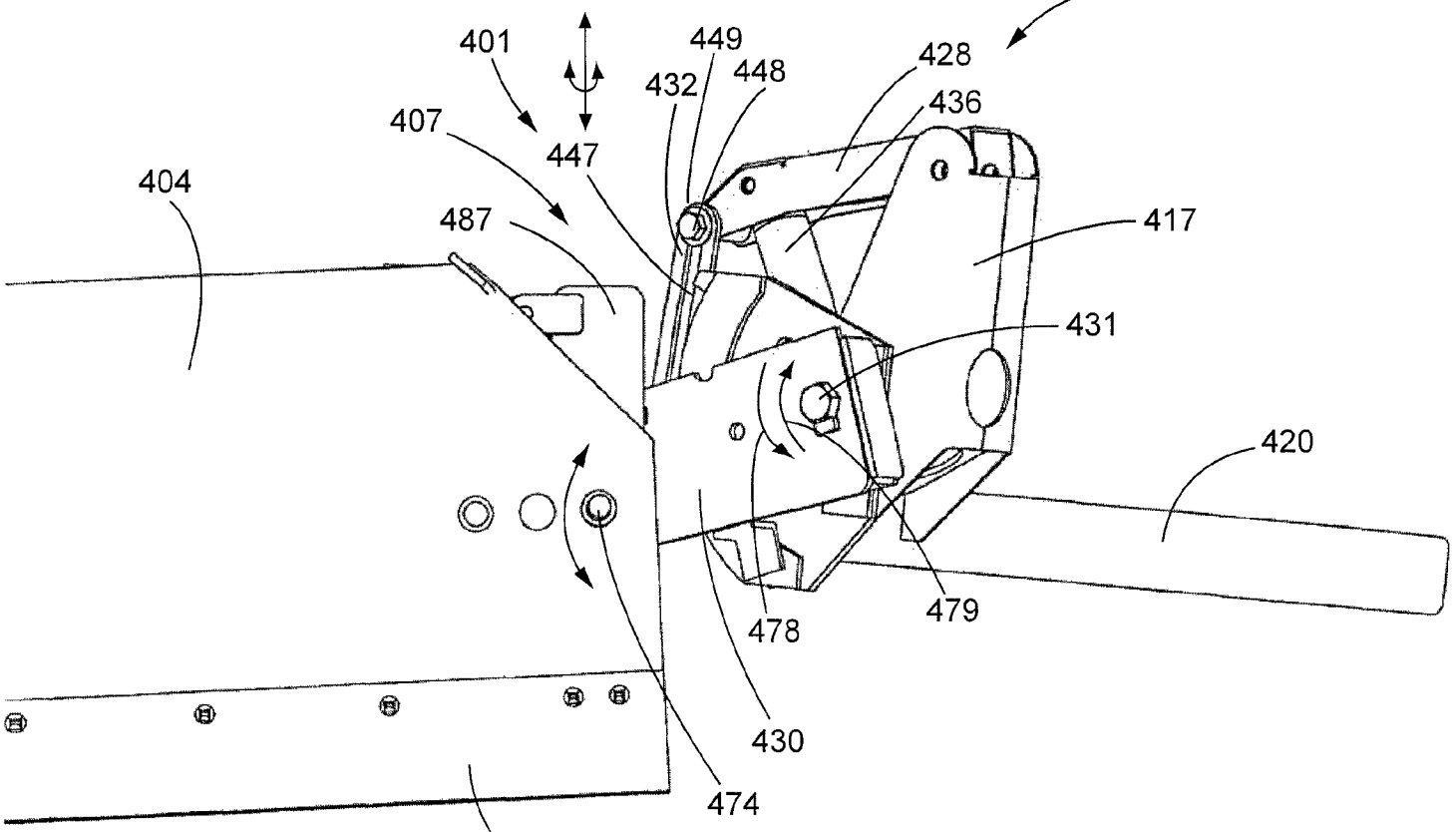
FIG. 11 is a fragmentary, side perspective view of the front portion of the wing plow of FIG. 8.
Figure 12:
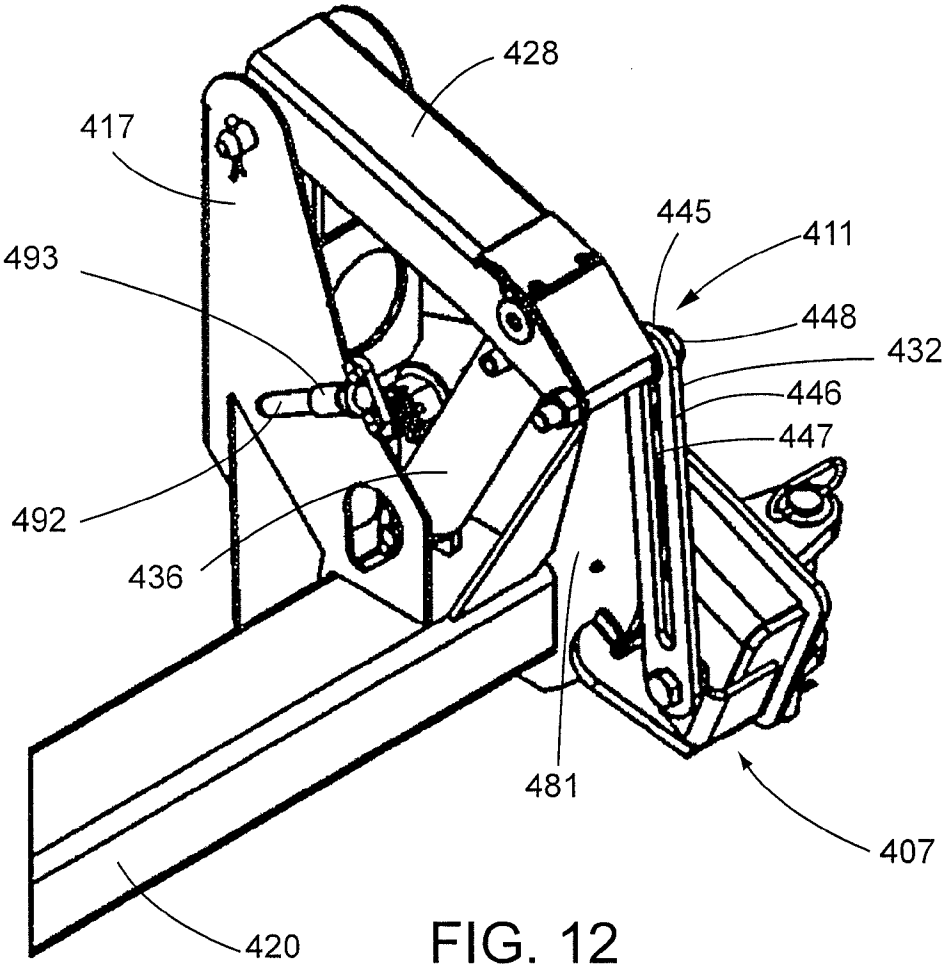
FIG. 12 is a fragmentary, interior perspective view from the rear of the front portion of the wing plow of FIG. 8.

Referring to FIGS. 9-11, a front portion 401 of the wing plow 402 of FIG. 8 is shown. A moldboard pivot pin 441 pivotably connects the moldboard 404 to a dee or connector plate 487 of the moldboard connector assembly 407 by extending through mounting holes in the dee 487 and the moldboard 404. A nut and washer combination 474 threaded to the moldboard pivot pin 441 or other suitable devices can be provided to secure the dee 487 and the moldboard 404 together axially along the moldboard pivot pin 441 while permitting relative rotation therebetween about the moldboard pivot pin 441. The illustrated dee 487 includes an additional mounting hole 476 which can be provided to mount the moldboard 404 at a different vertical position and/or to allow the moldboard connector assembly 407 to be used with a variety of moldboards having different sizes and/or mounting hole locations.

Referring to FIGS. 9-13, the toe end lift assembly 411 includes an upright 417 extending from the support frame 420, a lift arm 428 pivotably mounted to the upright 417, an actuator 436 in the form of a hydraulic cylinder pivotably mounted to the support frame 420 and to the lift arm 428, and a support linkage 432 connected to the lift arm 428 and to a link arm 430 of the moldboard connector assembly 407. The actuator 436 is adapted to move the lift arm 428 over a range of travel between a plowing position (see, e.g., FIGS. 8 and 27) and a storage position (see, e.g., FIG. 26).

The illustrated support linkage 432 comprises a slide linkage defining a slot 447 and a mounting pin 448 extending from the lift arm 428. The mounting pin 448 extends through the slot 447 of the slide linkage 432. The mounting pin 448 supports the slide linkage 432 at a proximal support end 445 of the slot 447 when the link arm 430 is in the lowered position (see, e.g., FIG. 11) such that the link arm 430 is constrained from moving in the lowering direction 478 beyond the lowered position. The slot 447 of the slide linkage 432 is configured such that the slide linkage 432 is movable with respect to the mounting pin 448 to allow the link arm 430 to pivot in the lifting direction 479 away from the lowered position over a predetermined range of travel. Preferably, the slot 447 and/or the mounting of the moldboard 404 to the moldboard connector assembly 407 are configured to allow the moldboard 404 to float such that the moldboard 404 can follow the ground contour from a reference vertical position to move both upwardly and downwardly over a range of travel based upon changes in the ground contour.

The slide linkage 432 is movably connected to the lift arm 428 such the slide linkage can pivot with respect to, and translate relative to, the mounting pin 448 and the lift arm 428. The distal end of the slide linkage 432 is pivotally connected to the link arm 430.

The slide linkage 432 is adapted to allow the moldboard 404 to move through a trip sequence such that the moldboard moves both rearwardly relative to the longitudinal axis of the chassis of the vehicle and vertically upward relative to the ground when the cutting edge 406 strikes an obstruction. As the moldboard 404 moves from a plowing position to a trip position, the link arm 430 pivots in a lifting direction 479 about the link arm pivot pin 431, thereby lifting the distal end 434 of the link arm 430 (see, e.g., FIGS. 12 and 13). As the distal end 434 of the link arm 430 rotates in the lifting direction 479, the slide linkage 432 moves upwardly in response. The mounting pin 448 and the lift arm 428 remain stationary such that the slide linkage 432 moves relative to them. The mounting pin 448 moves within the slot 447 of the slide linkage 432 toward the distal end of the slide linkage 432 as the link arm 430 pivots about the link arm pivot pin 431 in the lifting direction 479. In this way, the slide linkage 432 allows the moldboard 404 to move rearwardly and upwardly through a trip sequence when the cutting edge 406 strikes an obstruction and to move back to a plowing position after the obstruction is cleared.

Figure 13:
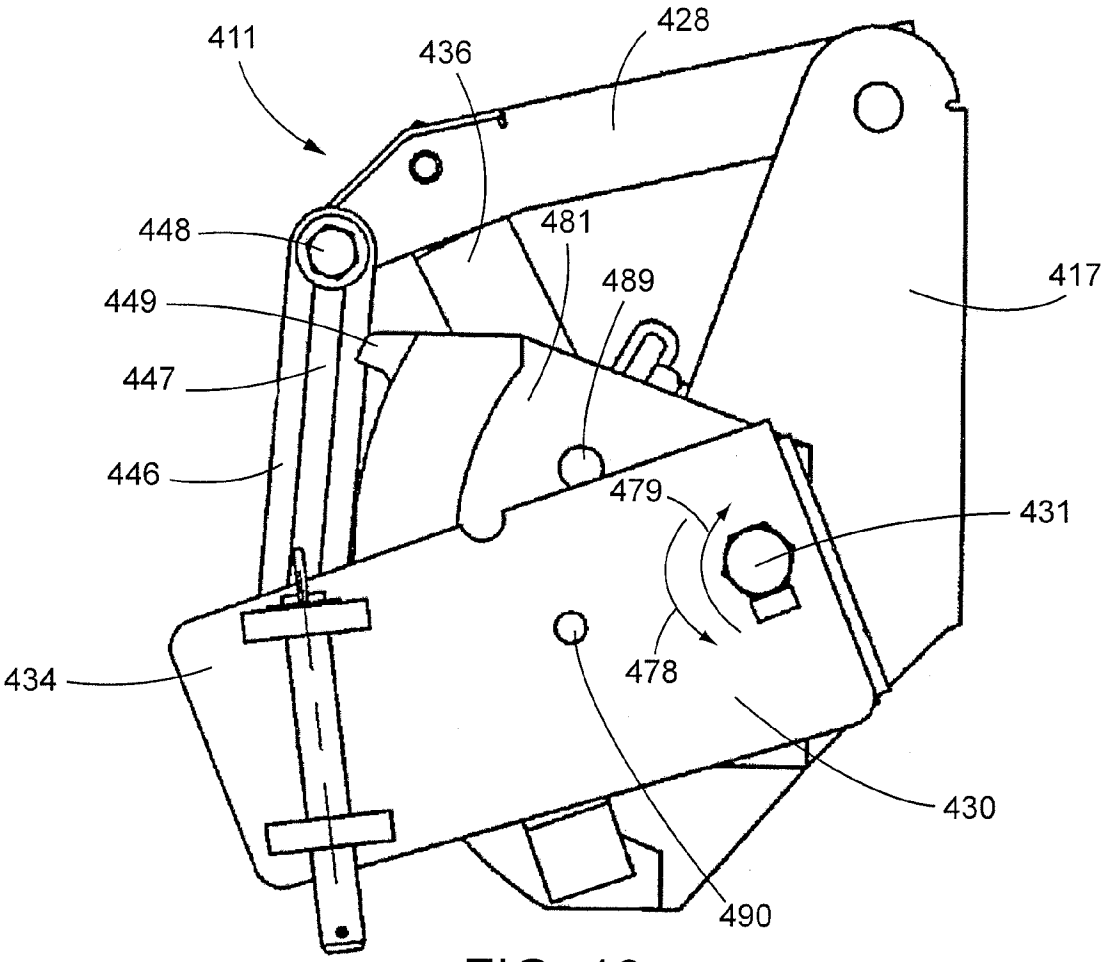
FIG. 13 is a side view of the front portion, as shown in FIG. 12, of the wing plow of FIG. 8.

Referring to FIG. 13, the moldboard connector assembly 407 includes a retaining plate 481 having an opening 489 therethrough that is adapted to align with a corresponding opening 490 in the link arm 430 when the link arm 430 is moved in the lifting direction 479 to a raised position. The link arm 430 can be in the raised position when the wing plow 402 is placed in a stowed position, as in FIG. 26, for example. An upper link arm stop 449 can be provided that is adapted to prevent the link arm 430 from moving in the lifting direction 479 beyond the raised position and to facilitate the alignment of the openings 489, 490.

A lock pin 492, 592 (see, e.g., FIGS. 12 and 18) can be inserted through the aligned openings 489, 490 to lock the link arm 430, 530 in the raised position. With the lock pin 492 in place, the link arm 430 is prevented from moving in the lowering direction 478 from the raised position. An operator can place the wing plow 402 in the stowed position and insert the lock pin 492 into the openings 489, 490 to provide a supplemental mechanical lock that prevents the wing plow 402 from moving from the stowed position. The lock pin 492 can be placed in a storage sleeve 493 mounted to the upright 417 when not in use (see, e.g., FIG. 12).

Figure 14:
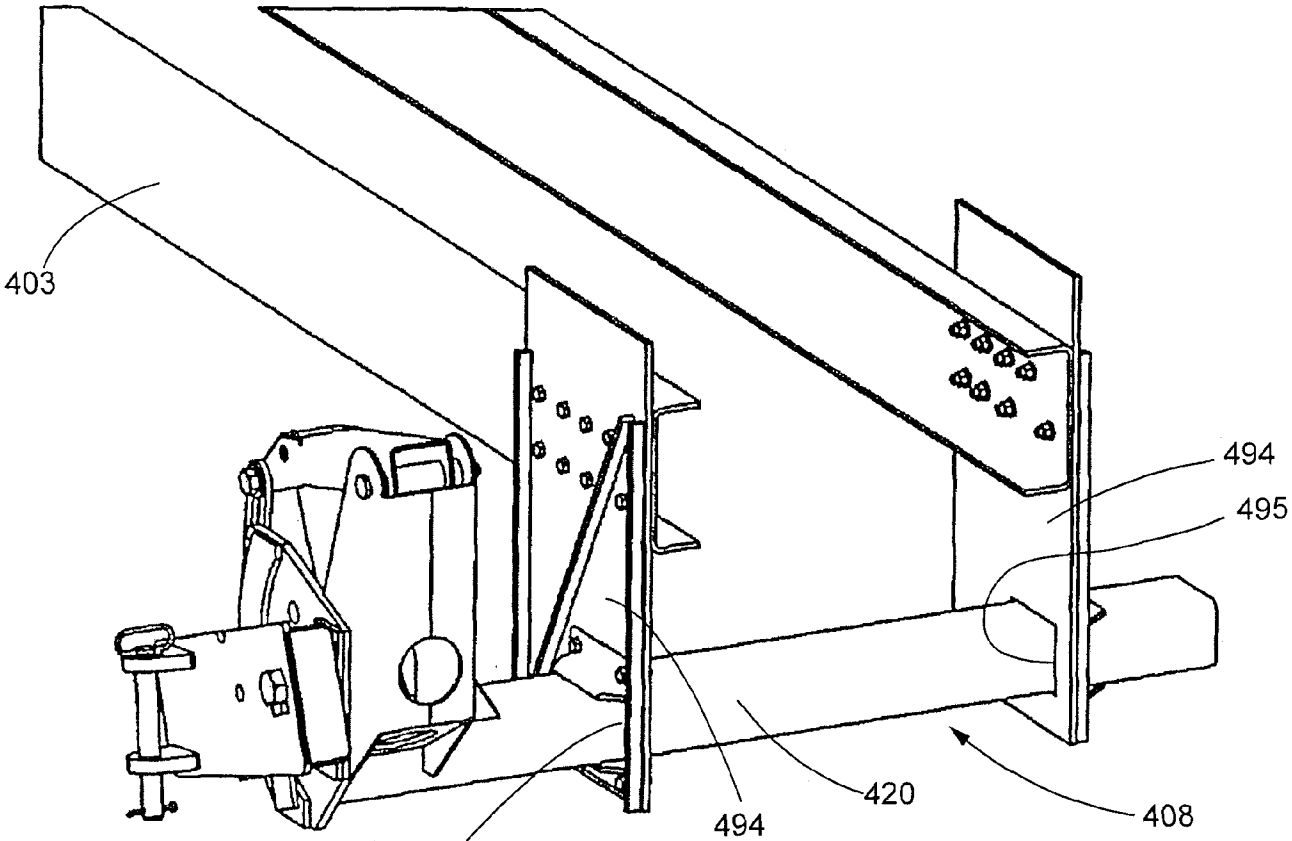
FIG. 14 is a perspective view of a mast of the wing plow of FIG. 8 mounted to a vehicle chassis.

Referring to FIG. 14, the front mast 408 can include a pair of mounting plates 494 adapted to mount the front mast 408 to a chassis 403. Each mounting plate 494 includes an opening 495 therethrough adapted to allow the cross brace 420 to extend therethrough. The plates 494 can be connected to the cross brace 420 using any suitable technique, such as with fasteners or by welding, for example. The plates 494 can be connected to the chassis using any suitable techniques, such as by fasteners, as shown. The vertical distance between the chassis and the cross brace 420 can be varied so as to adjust the normal plowing position of the wing plow 402. In other words, when installing the wing plow 402 to the chassis, an operator can position the cross brace 420 at a predetermined height above the ground and then connect the plates 494 to the chassis 403. Any portion of the plates 494 extending above the chassis 403 can be trimmed.

Figure 15:
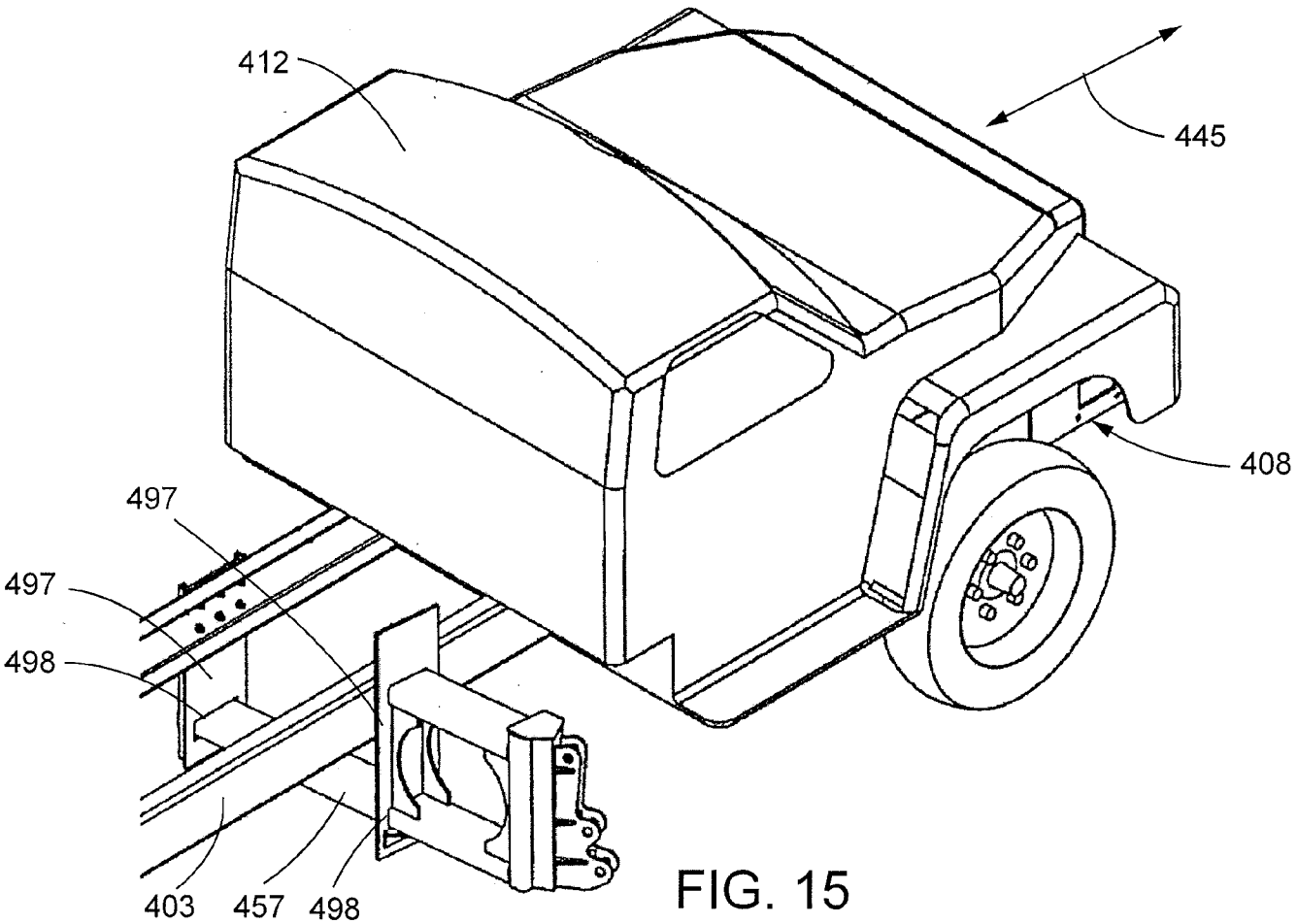
FIG. 15 is a perspective view of a rear mast of the wing plow of FIG. 8 mounted to a vehicle chassis.

Referring to FIG. 15, the rear mast 457 can also include a pair of mounting plates 497 which are adapted to mount the rear mast 457 to the chassis 403 at a predetermined location behind the front mast. Each mounting plate 497 includes an opening 498 therethrough which is adapted to allow the rear cross brace 457 to extend therethrough. The plates 497 can be connected to the rear cross brace 457 using any suitable technique, such as with fasteners or by welding, for example.

The longitudinal distance separating the front mast 408 and the rear mast 457 along the longitudinal axis of the chassis helps define the plowing angle (the angle between the longitudinal axis 445 of the chassis 403 and the plowing surface 421 of the moldboard 404) of the moldboard 404 when in a plowing position.

The wing plow 402 of FIG. 8 is similar in other respects to the wing plow 102 of FIG. 1. Components of the wing plow 402 of FIG. 8 can be constructed and function in a manner similar to corresponding components of the wing plow 102 of FIG. 1.

Figure 17:
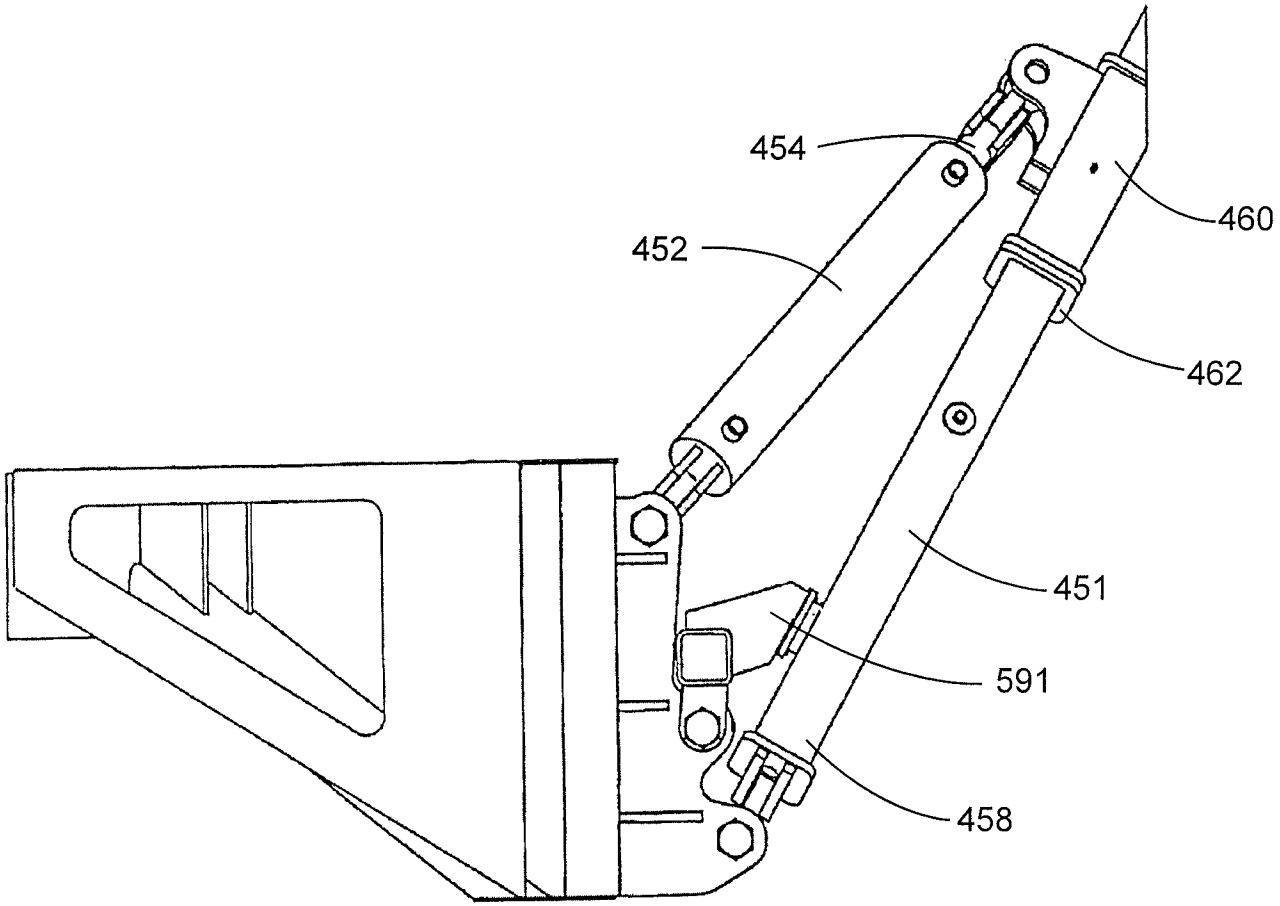
FIG. 17 is a fragmentary view of a portion of a brace assembly suitable for use in a wing plow constructed in accordance with principles of the present disclosure, illustrating the position of the brace assembly when the wing plow is in a stowed position.
Figure 18:
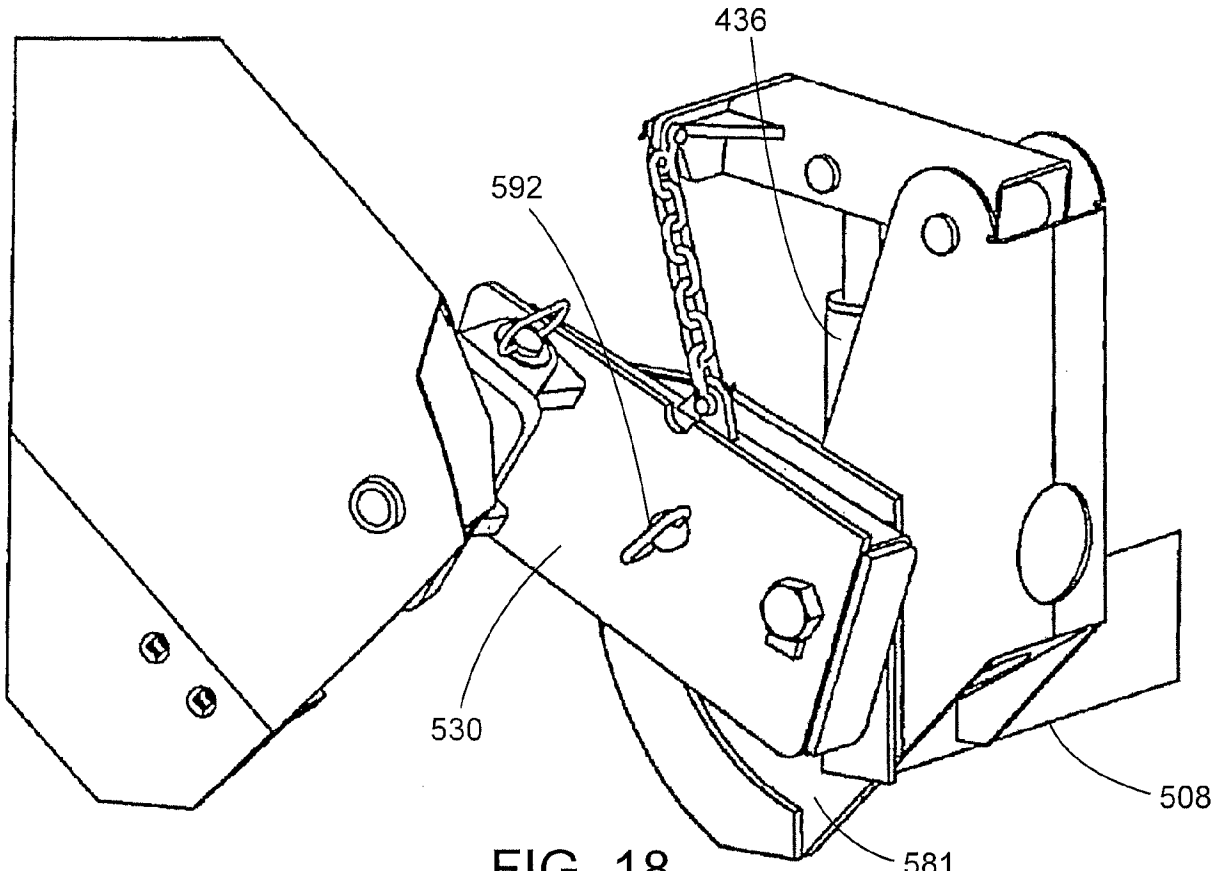
FIG. 18 is a fragmentary, perspective view of a portion of a wing plow constructed in accordance with principles of the present disclosure including a moldboard connector assembly, illustrating the wing plow in a stowed and locked position with a lock pin extending through bores in a link arm and a retaining plate mounted to a mast.

Referring to FIGS. 16-18, the wing plow 402 and other components suitable for use in a wing plow constructed according to principles of the present disclosure are shown in a stowed position. In the illustrated embodiments, the wing plow 402 is positioned near the cab 412 while in the stowed position with the heel end 424 of the moldboard 404 elevated relative to the toe end 422.

In embodiments, an operator can use a controller in the cab 412 or elsewhere on the vehicle 100 to cause the actuator 436 (see, e.g., FIG. 18) of the toe end lift assembly 411 to move the lift arm 428 upwardly, thereby lifting the link arm 430 and the toe end 422 of the moldboard 404 into the stowed position. As the lift arm 428 moves upwardly, the mounting pin 448 pulls the slide linkage 432 upward, which in turn lifts the distal end of the link arm 430. As the distal end of the link arm 430 moves upwardly and pivots about the link arm pivot pin 431, the front end 422 of the moldboard 404 moves upward into the stowed position.

Referring to FIG. 17, in some embodiments, to move the moldboard 404 to the stowed position, an operator can use a controller in the cab 412 or elsewhere on the vehicle 400 to control an actuator 452 so that it moves to a retracted position, as shown in FIG. 17. As the illustrated piston 454 retracts into the cylinder 452, the slide collar 460 moves along the push arm 451 toward the proximal arm stop 462. Once the slide collar 460 engages the proximal arm stop 462, the continued retraction of the piston 454 causes the push arm 451 to pivot vertically upward about its proximal end 458, thereby also lifting the heel end 424 of the moldboard 404, as illustrated, e.g., in FIG. 16. In embodiments, a push arm pivot stop 591 can be provided to limit the upward pivotal movement of the push arm 451 to facilitate placing the wing plow in the stowed position.

Referring to FIG. 18, with the wing plow in the stowed position, the lock pin 592 can be used to lock the link arm 530 in place relative to the retaining plate 581 and the mast 508. When the wing plow is to be moved from the stowed position, the lock pin 592 can be removed from the link arm 530 and the retaining plate 581 to allow the link arm 530 to rotate. Referring to FIG. 16, to return the wing plow 402 to a plowing position, the piston 454 extends out of the cylinder 452 to lower the heel end 424 of the moldboard 404, and the cylinder 436 (see, e.g., FIG. 18) lowers the lift arm 428 to lower the toe end 422 of the moldboard 404.

Figure 19:
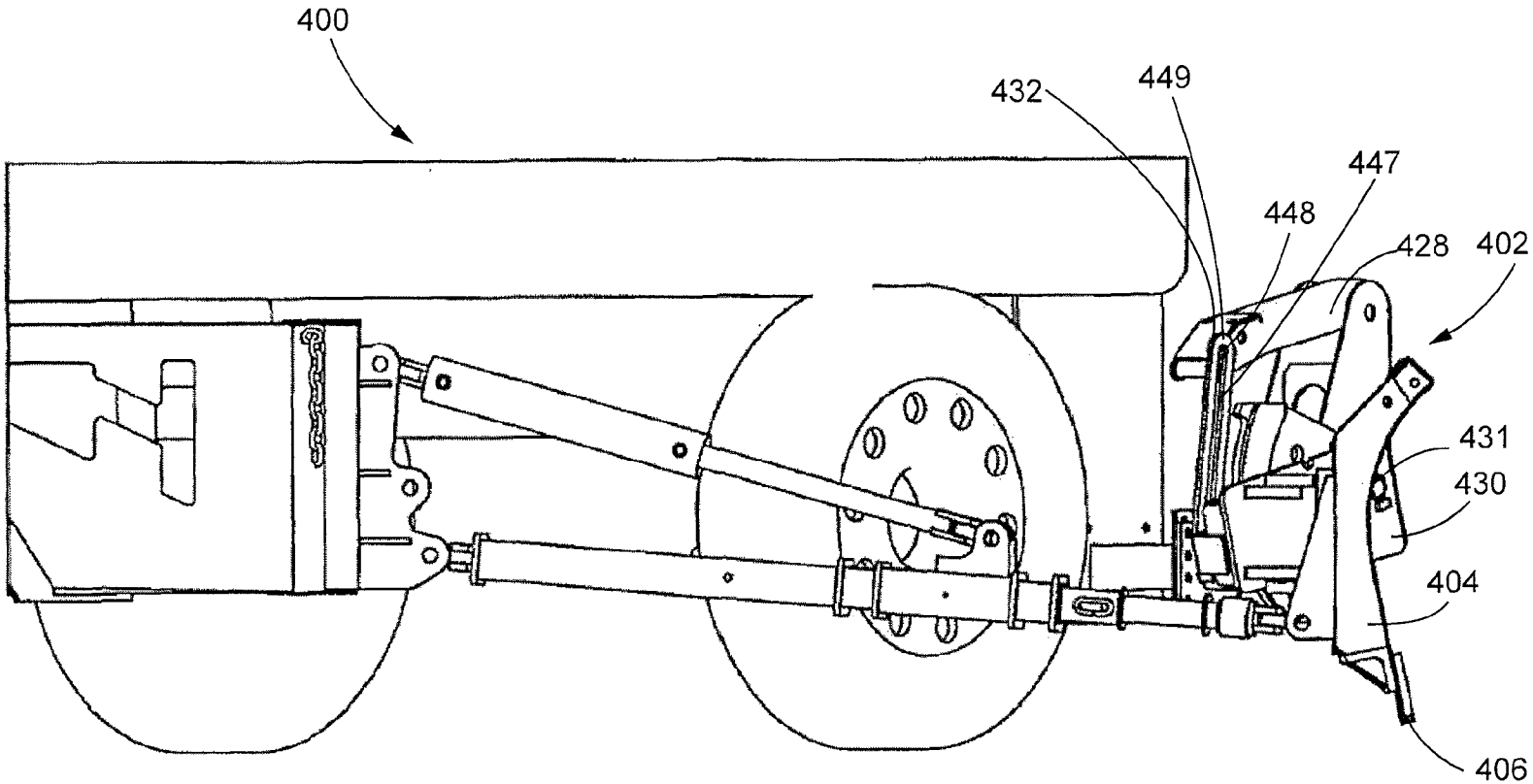
FIG. 19 is a fragmentary, side perspective view of a vehicle with the wing plow assembly of FIG. 8 mounted thereto, illustrating the wing plow in a plowing position.
Figure 20:
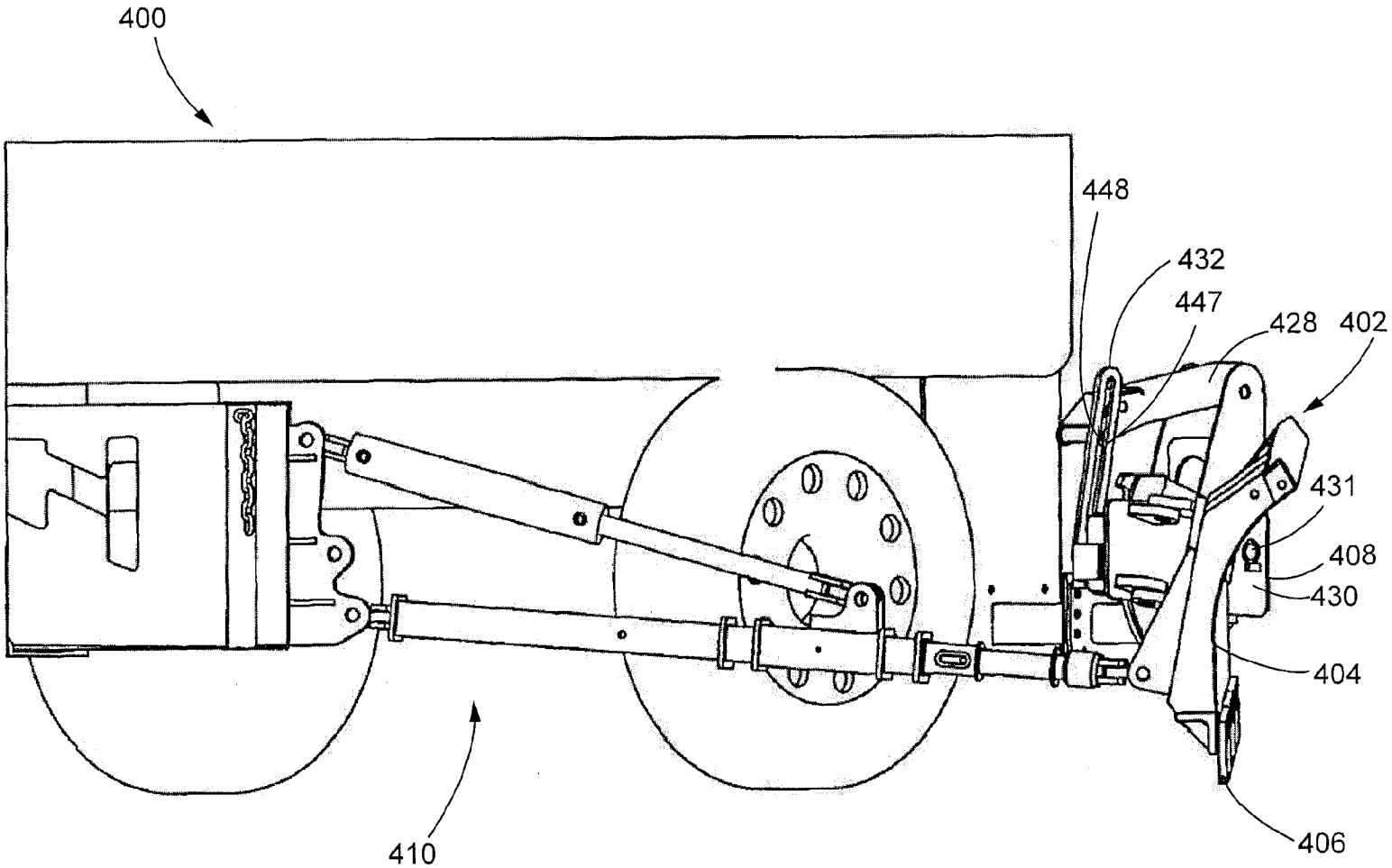
FIG. 20 is a view as in FIG. 19, but illustrating the wing plow in a partially tripped position.
Figure 21:
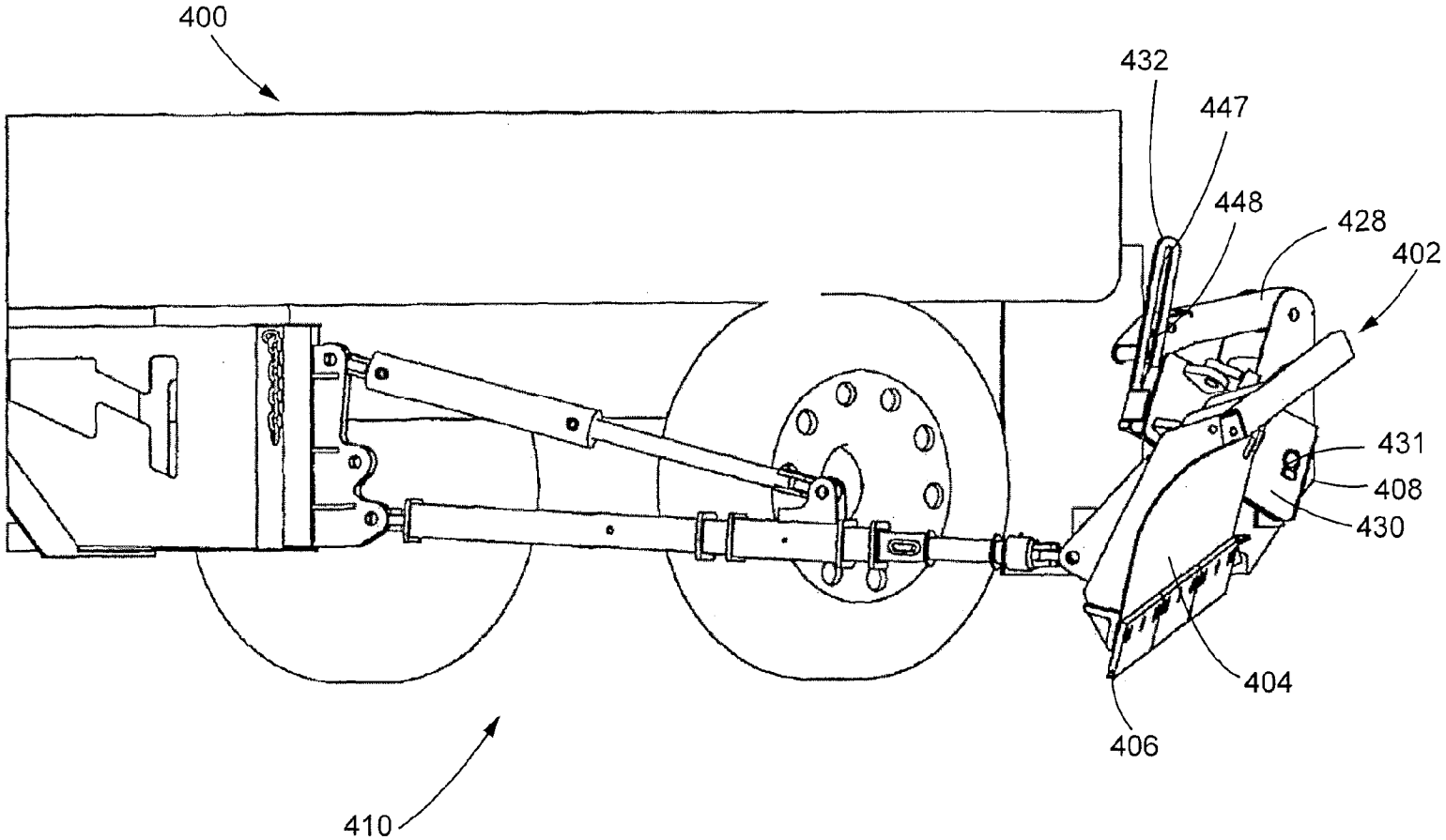
FIG. 21 is a view as in FIG. 19, but illustrating the wing plow in a fully tripped position.

FIGS. 19-21 show the wing plow 402 mounted to the vehicle 400 and a trip sequence as the wing plow 402 moves from a plowing position (FIG. 19), through a partially tripped position (FIG. 20), and to a fully tripped position (FIG. 21). As shown in FIG. 19, when in the plowing position, the mounting pin 448 is positioned near the proximal end 449 of the slot 447 in the slide linkage 432.

As the wing plow 402 moves into the partially tripped position shown in FIG. 20, the moldboard 404 and the cutting edge 406 move rearwardly relative to the front mast 408 and upwardly relative to the ground. In response, the link arm 430 rotates upwardly about the link arm pivot pin 431, thereby moving the slide linkage 432 upwards in relation to the lift arm 428 and the mounting pin 448. The brace assembly 410 pivots upward slightly in response to the movement of the moldboard 404.

In the fully tripped position illustrated in FIG. 21, the moldboard 404 and the cutting edge 406 have moved even further rearwardly relative to the front mast 408 and upwardly relative to the ground. The rearward and vertical movement of the moldboard 404 causes the link arm 430 to pivot even further upwardly about the link arm pivot pin 431 and moves the slide linkage 432 further upwardly with respect to the lift arm 428 and the mounting pin 448. In the fully tripped position, the cutting edge 406 of the moldboard 404 is elevated over the encountered obstruction. The brace assembly 410 is pivoted further upwardly in response to the movement of the moldboard 404. Once the cutting edge 406 has cleared the obstruction, the wing plow 402 returns to the plowing position.

Figure 23:
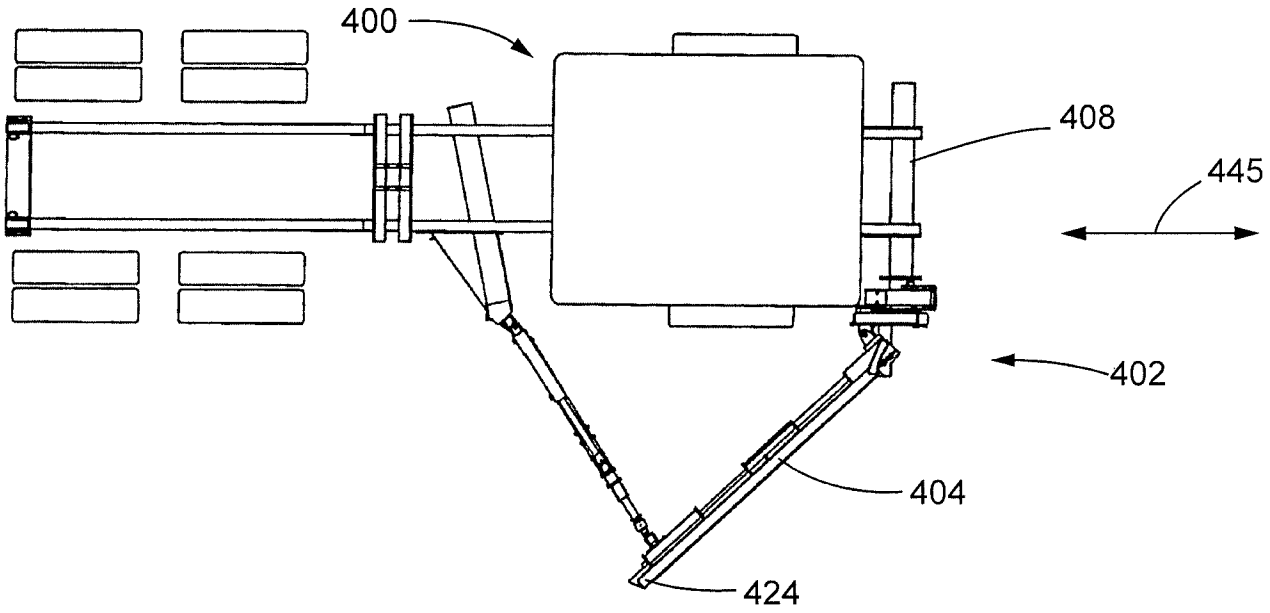
FIG. 23 is a view as in FIG. 22, but illustrating the wing plow in a plowing position.
Figure 24:
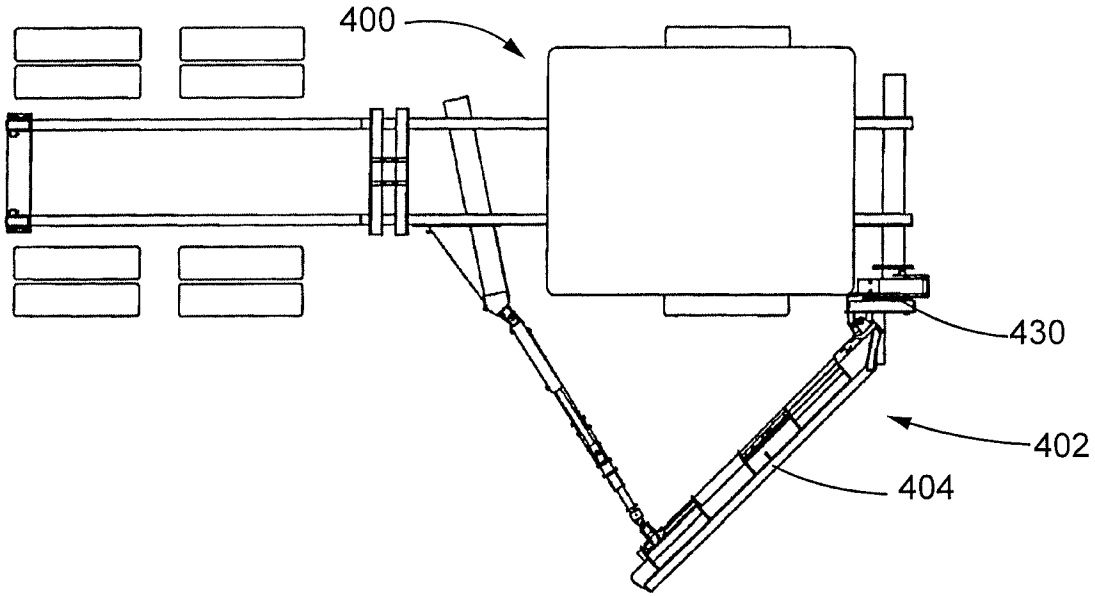
FIG. 24 is a view as in FIG. 22, but illustrating the wing plow in a partially tripped position.
Figure 25:
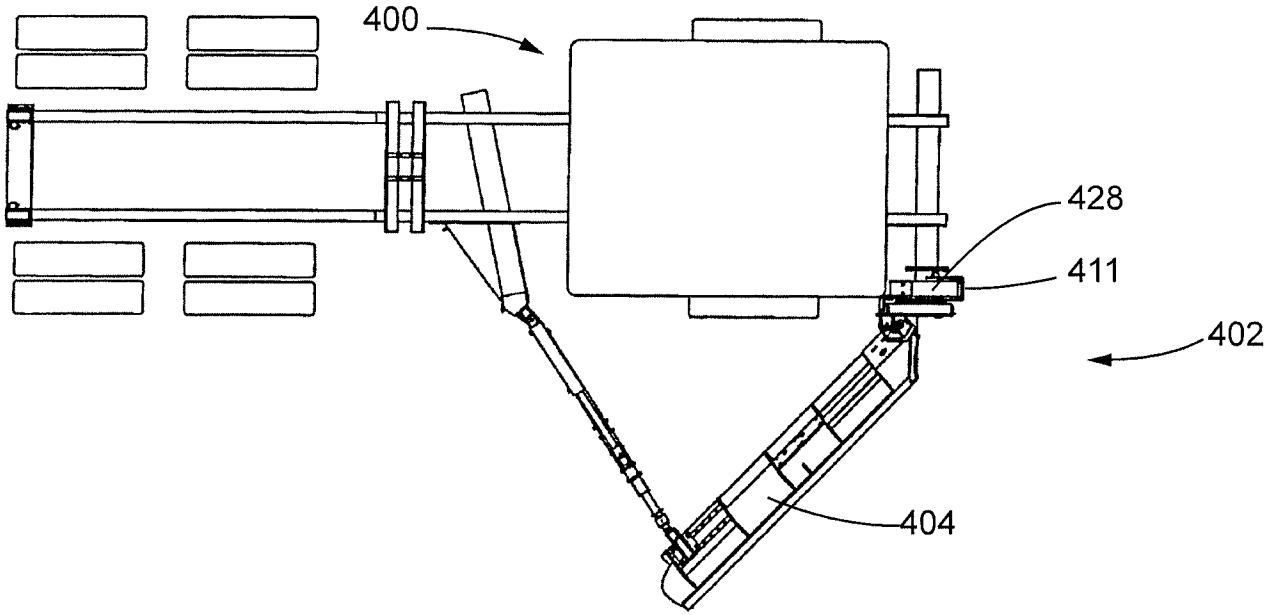
FIG. 25 is a view as in FIG. 22, but illustrating the wing plow in a fully tripped position.
Figure 27:
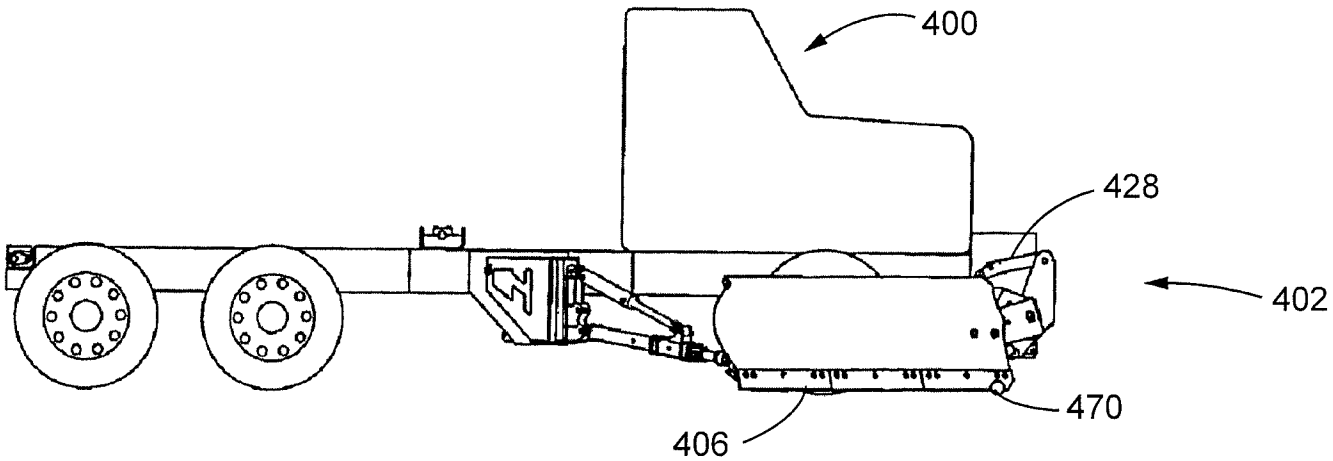
FIG. 27 is a view as in FIG. 26, but illustrating the wing plow in the plowing position shown in FIG. 23.
Figure 28:
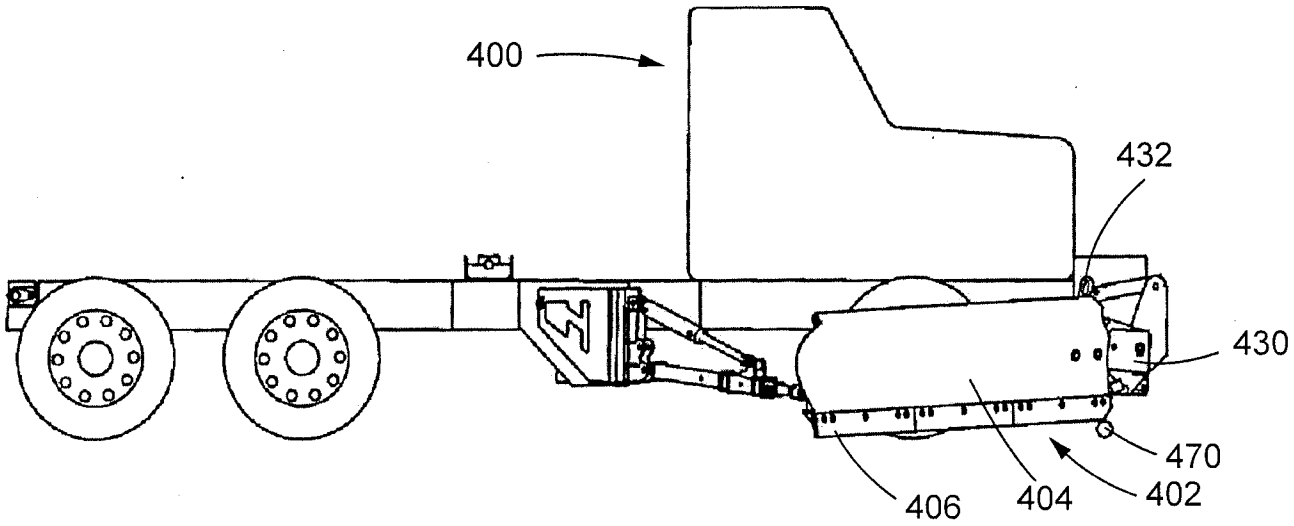
FIG. 28 is a view as in FIG. 26, but illustrating the wing plow in the partially tripped position shown in FIG. 24.
Figure 29:
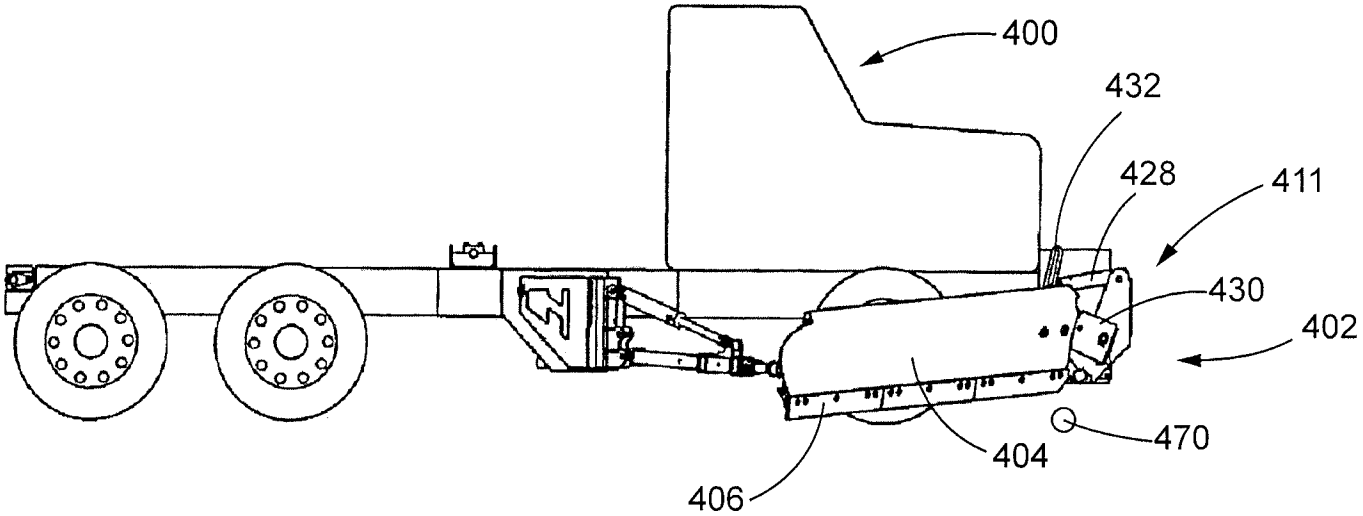
FIG. 29 is a view as in FIG. 26, but illustrating the wing plow in the fully tripped position shown in FIG. 25.

FIGS. 22-29 illustrate the wing plow 402 mounted to the vehicle 400 and moved to a variety of positions. The wing plow 402 is shown in the stowed position (FIGS. 22 and 26), a plowing position (FIGS. 23 and 27), a partially tripped position (FIGS. 24 and 28), and a fully tripped position (FIGS. 25 and 29).

Figure 22:
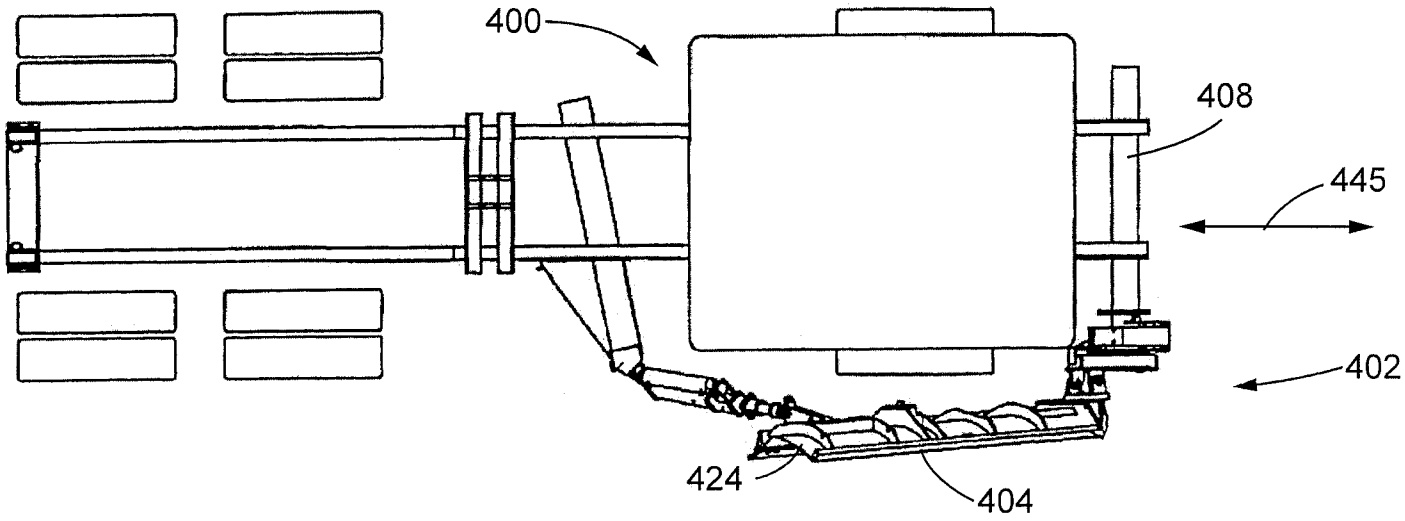
FIG. 22 is a top plan view of a vehicle with the wing plow assembly of FIG. 8 mounted thereto, illustrating the wing plow in a stowed position.

Referring to FIGS. 22 and 23, the heel end 424 of the moldboard 404 is in a first lateral position with respect to the mast 408 and the central longitudinal axis 445 when in the plowing position and in a second lateral position with respect to the mast 408 and the longitudinal axis 445 in the stowed position. The first lateral position is laterally outward from the second lateral position relative to the central longitudinal axis 445.

FIGS. 23 and 27 illustrate the vehicle 400 with the wing plow 402 in the plowing position. An obstruction 470 illustrated in FIG. 27 represents the type of obstruction that the cutting edge 406 can encounter while plowing.

FIGS. 24 and 28 illustrate the vehicle 400 with the wing plow 402 in the partially tripped position. In the partially tripped position, the cutting edge 406 is slightly elevated with respect to the obstruction 470. Additionally the link arm 430 has pivoted upward, moving the slide linkage 432 in response to the movement of the moldboard 404.

FIGS. 25 and 29 illustrate the vehicle 400 with the wing plow 402 in a fully tripped position. In the fully tripped position, the cutting edge 406 is fully elevated over the obstruction 470. Additionally the link arm 430 has pivoted further upward, further moving the slide linkage 432 relative to the lift arm 428 in response to the movement of the moldboard 404. The moldboard 404 and the cutting edge 406 can undergo the tripping sequence without interference from the toe end lift assembly 411.

Figure 30:
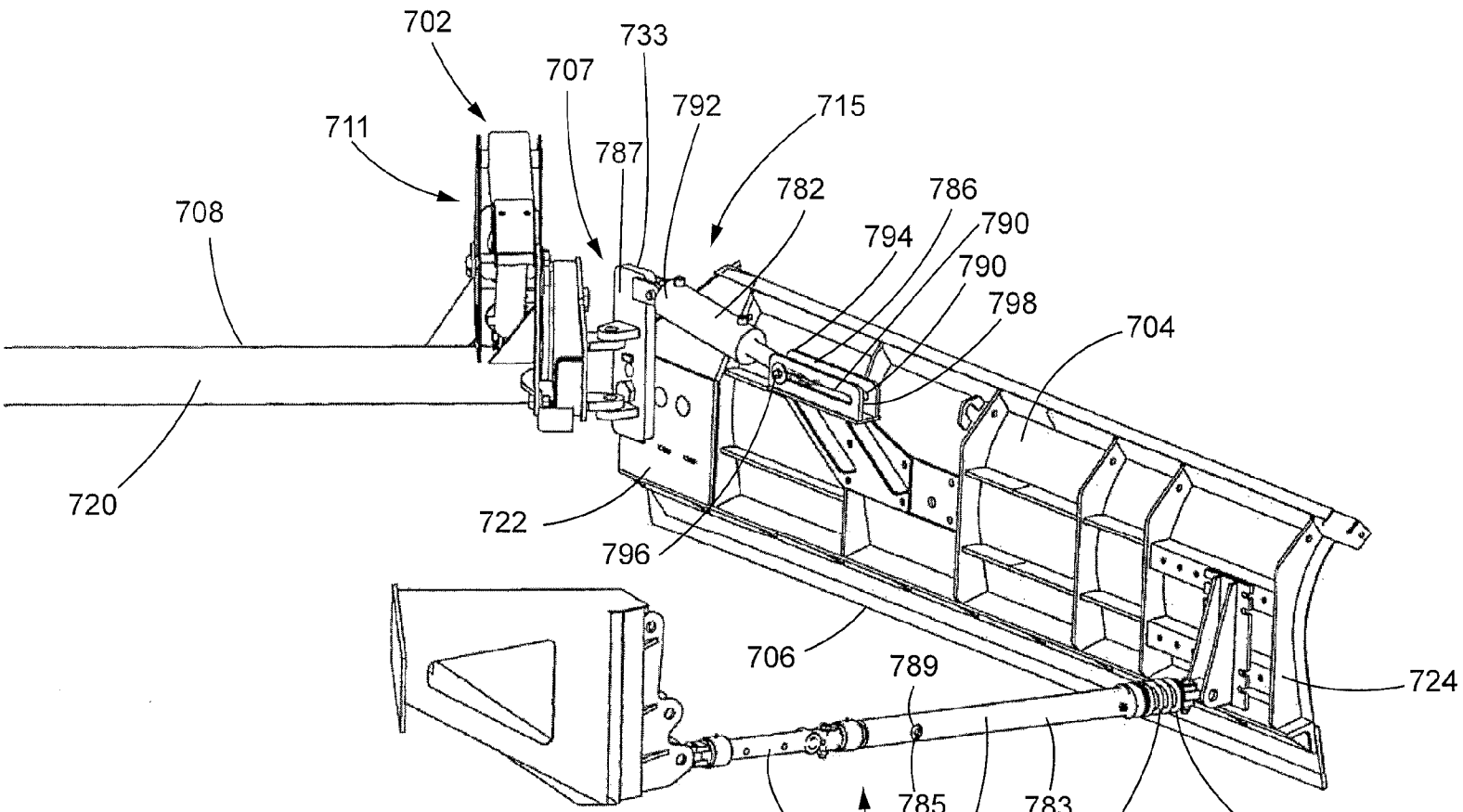
FIG. 30 is a rear perspective view of another embodiment of a wing plow constructed in accordance with principles of the present disclosure.

Referring to FIG. 30, another embodiment of a wing plow assembly 702 constructed according to principles of the present disclosure is shown. The wing plow 702 includes a mast 708 including a support frame 720 adapted for mounting to a chassis of a vehicle, a moldboard 704 having a front or toe end 722 and a rear or heel end 724, a moldboard connector assembly 707 arranged with the moldboard 704 and the mast 708 to provide a rotatable floating connection between the moldboard 704 and the mast 708 such that the moldboard 704 is rotatably movable over a range of travel between a plowing position (as shown in FIG. 30) and a range of tripped positions, a brace assembly 710, a toe end lift assembly 711, and a heel end lift assembly 715.

The brace assembly 710 includes a push arm 751 that is adapted to be axially adjustable over a range of travel between a retracted position and an extended position such that the push arm 751 has a variable axial length. The push arm 751 includes a pair of segments 781, 783 that are telescopically movable with respect to each other. To adjust the axial length of the push arm 751, the proximal segment 781 can be retracted into or extended out of the distal segment 783. A lock pin 785 can be inserted through a mounting hole 787 of the distal segment 783 and one of a series of mounting holes in axial spaced relationship to each other that is aligned with the mounting hole 787 of the distal segment 783 to restrain further relative movement between the proximal and distal segments 781, 783.

A distal end 756 of the push arm 751 is equipped with a reciprocally movable extension piece 771 having a spring 776 mounted thereto which function as a shock absorber adapted to absorb some of the impact when the cutting edge 706 encounters an obstruction.

When the cutting edge 706 strikes an obstruction while plowing, the extension piece 771 compresses and retracts into the distal segment 783 to allow the heel end 724 of the moldboard 704 to move at least slightly horizontally rearward relative to the front mast 708. Once the cutting edge 706 is clear of the obstruction, the spring 776 urges the extension piece 771 to extend outwardly from the distal segment 783 and return to the position shown in FIG. 30.

The heel end lift assembly 715 includes an actuator 782 pivotably mounted between a moldboard mount 733 and the moldboard 704. The actuator 782 has a proximal end 792 that is pivotably connected to an extended dee or connector plate 787. A distal end 796 of the actuator 782 is pivotably mounted to the moldboard 704 by way of a U-shaped channel or carriage 786 mounted to the moldboard 704. The carriage 786 defines a pair of slots 790 therein. The distal end 796 of the actuator includes a pin that extends through the slots 790 of the carriage 786 to inter-engage the actuator 782 and the moldboard 704.

The distal end 796 of the actuator 782 is engageable with a proximal end 794 of the carriage 786 to selectively lift the heel end 724 of the moldboard 704 to move the moldboard 704 from a plowing position to a stowed position. The distal end 796 of the actuator 782 is movably disposed within the slots 790 such that the distal end 796 of the actuator 782 moves with respect to the carriage 786 and the actuator 782 pivots with respect to the extended dee 787 when the moldboard 704 rotates from a plowing position to a tripped position.

As the moldboard 704 rotates when moving through a trip sequence, the distal end 796 of the actuator 782 moves in the slots 790 relative to the carriage 786 toward a distal end 798 thereof to allow the moldboard 704 to move through the trip sequence without requiring the operation of the heel end lift assembly 715. The actuator 782 pivots with respect to the extended dee 787 to accommodate the moldboard 704 movement. Once the obstruction is cleared, the moldboard 704 returns to the plowing position and the distal end 796 of the actuator 782 moves in the slots 790 relative to the carriage 786 toward the proximal end 794 thereof.

The wing plow 702 of FIG. 30 is similar in other respects to the wing plow 402 of FIG. 8. Components of the wing plow 702 of FIG. 30 can be constructed and function in a manner similar to corresponding components of the wing plow 402 of FIG. 8.

The language used in the specification has been principally selected for readability and instructional purposes. Accordingly, the disclosure is intended to be illustrative, but not limiting, of the scope of the invention. While the invention has been described in terms of various specific embodiments, those skilled in the art will recognize that the invention can be practiced with modification within the spirit and scope of the claims.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description.

The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A wing plow comprising:

a mast including a support frame adapted for mounting to a chassis;

a moldboard having a toe end and a heel end;

a moldboard connector assembly arranged with the moldboard and the mast to provide a rotatable floating connection between the moldboard and the mast such that the moldboard is rotatably movable over a range of travel between a plowing position and a range of tripped positions, the moldboard connector assembly including a link arm pivotably mounted with respect to the support frame and a moldboard mount pivotably mounted to the moldboard adjacent the toe end of the moldboard, the link arm being pivotably movable with respect to the support frame about a link arm pivot axis, and the link arm and the moldboard mount pivotably connected to each other to permit relative rotation therebetween about a plowing axis;

a toe end lift assembly adapted to be mounted to the support frame and adapted to selectively move the toe end of the moldboard over a range of travel along the plowing axis between a plowing position and a stowed position, the toe end lift assembly being connected to the link arm such that the link arm is constrained from pivoting about the link arm pivot axis in a lowering direction beyond a lowered position but allowed to move in a lifting direction away from the lowered position, the lifting direction being in opposing relationship to the lowering direction.

2. The wing plow of claim 1, wherein the moldboard connector assembly is adapted to provide relative movement between the moldboard and the mast with three degrees of freedom.

3. The wing plow of claim 2, wherein the moldboard is pivotably movable with respect to the moldboard mount at the toe end about a toe end moldboard pivot axis, and wherein the plowing axis is generally perpendicular to the link arm pivot axis and to the toe end moldboard pivot axis.

4. The wing plow of claim 1, wherein the moldboard connector assembly includes an adjustment mechanism adapted to change the orientation of the plowing axis with respect to a supporting surface.

5. The wing plow of claim 1, wherein the link arm includes a clevis bracket, the moldboard mount includes a connector plate having a clevis bracket, and the link arm and the connector plate are pivotably connected together by a pin extending through the clevis brackets.

6. The wing plow of claim 1, wherein the moldboard connector assembly includes a retaining plate mounted to the support frame, the link arm is pivotably mounted to the retaining plate such that the link arm is pivotable about a link arm pivot axis, the link arm includes a retaining member defining a groove, the retaining plate and the link arm positioned with respect to each other such that a portion of the retaining plate is disposed within the groove such that the retaining member is engageable with the retaining plate to restrain relative movement of the link arm away from the retaining plate along the link arm pivot axis.

7. The wing plow of claim 1, further comprising:

a heel end lift assembly operable to selectively move the heel end of the moldboard over a range of travel along the plowing axis between the plowing position and the stowed position, the heel end of the moldboard being in a first lateral position with respect to the mast when in the plowing position and in a second lateral position with respect to the mast when in the stowed position, the first lateral position being laterally outward from the second lateral position.

8. The wing plow of claim 1, wherein the toe end lift assembly is connected to the link arm such that the link arm is allowed, without operation of the toe end lift assembly, to float by pivoting in a lowering direction to a ground-engaging position when the moldboard is under the influence of gravity, and in a lifting direction to a tripped position when the moldboard encounters an obstruction, the lifting direction being in opposing relationship to the lowering direction.

9. The wing plow of claim 1, wherein the toe end lift assembly includes an upright extending from the support frame, a lift arm pivotably mounted to the upright, an actuator pivotably mounted to the support frame and to the lift arm, the actuator adapted to move the lift arm over a range of travel between a plowing position and a storage position, and a support linkage connected to the lift arm and to the link arm, and wherein the support linkage is adapted to constrain the link arm from pivoting in the lowering direction beyond the lowered position and to allow the link arm to pivot in the lifting direction away from the lowered position.

10. The wing plow of claim 9, wherein the support linkage comprises a flexible tension device.

11. The wing plow of claim 9, wherein the support linkage comprises a slide linkage defining a slot and a mounting pin extending from the lift arm, the mounting pin extending through the slot of the slide linkage, the mounting pin supporting the slide linkage at a proximal support end of the slot when the link arm is in the lowered position such that the link arm is constrained from moving in the lowering direction beyond the lowered position, the slot of the slide linkage configured such that the slide linkage is movable with respect to the mounting pin to allow the link arm to pivot in the lifting direction away from the lowered position over a predetermined range of travel.

12. The wing plow of claim 1, further comprising:

a cutting edge connected to the moldboard.

13. The wing plow of claim 1, further comprising:

a brace assembly having a push arm with a distal end pivotably mounted to the moldboard adjacent the heel end of the moldboard.

14. The wing plow of claim 13, wherein the push arm is axially adjustable over a range of travel between a retracted position and an extended position such that the push arm has a variable axial length.

15. The wing plow of claim 13, wherein the brace assembly includes a mounting bracket, and a proximal end of the push arm is pivotably mounted to the mounting bracket, and the wing plow further comprises:

a heel end lift assembly operable to selectively move the heel end of the moldboard over a range of travel along the plowing axis between a plowing position and a stowed position, the heel end of the moldboard being in a first lateral position with respect to the mast when in the plowing position and in a second lateral position with respect to the mast when in the stowed position, the first lateral position being laterally outward from the second lateral position, the heel lift assembly including an actuator having a proximal end pivotably mounted to the mounting bracket and a distal end pivotably mounted to the push arm, the actuator movable over a range of travel between an extended position and a retracted position to place the push arm in the plowing position and the stowed position, respectively.

16. The wing plow of claim 1, further comprising:

a heel end lift assembly operable to selectively move the heel end of the moldboard over a range of travel along the plowing axis between a plowing position and a stowed position, the heel end of the moldboard being in a first lateral position with respect to the mast when in the plowing position and in a second lateral position with respect to the mast when in the stowed position, the first lateral position being laterally outward from the second lateral position.

17. The wing plow of claim 16, wherein the heel end lift assembly includes an actuator pivotably mounted between the moldboard mount and the moldboard.

18. The wing plow of claim 17 wherein the heel end lift assembly includes a carriage movably mounted to the moldboard such that the carriage is movable with respect to the moldboard when the moldboard rotates from a plowing position to a tripped position, the carriage defining a slot therein, a distal end of the actuator of the heel lift assembly movably disposed within the slot, the distal end of the actuator engageable with a proximal end of the carriage to selectively lift the heel of the moldboard.

19. A vehicle comprising:

a chassis;

a wing plow mounted to the chassis, the wing plow including:

a mast including a support frame mounted to the chassis, a moldboard having a toe end and a heel end, a moldboard connector assembly arranged with the moldboard and the mast to provide a rotatable floating connection between the moldboard and the mast such that the moldboard is rotatably movable over a range of travel between a plowing position and a range of tripped positions, the moldboard connector assembly including a link arm pivotably mounted with respect to the support frame and a moldboard mount pivotably mounted to the moldboard adjacent the toe end of the moldboard, the link arm being pivotably movable with respect to the support frame about a link arm pivot axis, and the link arm and the moldboard mount pivotably connected to each other to permit relative rotation therebetween about a plowing axis, and a toe end lift assembly mounted to the support frame and adapted to selectively move the toe end of the moldboard over a range of travel along the plowing axis between a plowing position and a stowed position, the toe end lift assembly being connected to the link arm such that the link arm is constrained from pivoting about the link arm pivot axis in a lowering direction beyond a lowered position but allowed to move in a lifting direction away from the lowered position, the lifting direction being in opposing relationship to the lowering direction.

20. The vehicle of claim 19, wherein the moldboard connector assembly is adapted to provide relative movement between the moldboard and the mast with three degrees of freedom.

21. The vehicle of claim 20, wherein the moldboard is pivotably movable with respect to the moldboard mount at the toe end about a toe end moldboard pivot axis, and wherein the plowing axis is generally perpendicular to the link arm pivot axis and to the toe end moldboard pivot axis.

22. The vehicle of claim 19, further comprising:

a heel end lift assembly operable to selectively move the heel end of the moldboard over a range of travel along the plowing axis between the plowing position and the stowed position, the heel end of the moldboard being in a first lateral position with respect to the mast when in the plowing position and in a second lateral position with respect to the mast when in the stowed position, the first lateral position being laterally outward from the second lateral position.

23. The vehicle of claim 19, wherein the toe end lift assembly is connected to the link arm such that the link arm is allowed, without operation of the toe end lift assembly, to float by pivoting in a lowering direction to a ground-engaging position when the moldboard is under the influence of gravity, and in a lifting direction to a tripped position when the moldboard encounters an obstruction, the lifting direction being in opposing relationship to the lowering direction.

24. The vehicle of claim 19, wherein the wing plow further includes:

a cutting edge connected to the moldboard.

25. The vehicle of claim 19, wherein the wing plow further includes:

a brace assembly having a push arm with a distal end pivotably mounted to the moldboard adjacent the heel end of the moldboard and a proximal end pivotably mounted with respect to the chassis.

26. The vehicle of claim 25, wherein the moldboard has a plowing surface extending between the heel end and the toe end of the moldboard, the plowing surface being disposed at a plowing angle with respect to the support frame, and the brace assembly is adjustable to selectively change the plowing angle.

* * * * *